US009513026B2

(12) United States Patent
Badenhorst

(10) Patent No.: US 9,513,026 B2
(45) **Date of Patent: *Dec. 6, 2016**

(54) AIR DIFFUSER AND AIR CIRCULATION SYSTEM

(75) Inventor: Sean Michael Johl Badenhorst, Dulwich Hills (AU)

(73) Assignee: KAIP Pty Limited (AU)

( * ) Notice: Subject to any disclaimer, the term of this patent is extended or adjusted under 35 U.S.C. 154(b) by 991 days.

This patent is subject to a terminal disclaimer.

(21) Appl. No.: 13/140,716

(22) PCT Filed: Dec. 18, 2009

(86) PCT No.: PCT/AU2009/001654

§ 371 (c)(1),
(2), (4) Date: Jul. 21, 2011

(87) PCT Pub. No.: WO2010/069001

PCT Pub. Date: Jun. 24, 2010

(65) Prior Publication Data

US 2011/0275304 A1 Nov. 10, 2011

(30) Foreign Application Priority Data

Dec. 19, 2008 (AU) ..... 2008906547

(51) Int. Cl.

| | |
|---|---|
| ***F24F 13/06*** | (2006.01) |
| ***F24F 7/10*** | (2006.01) |
| *F24F 11/00* | (2006.01) |

(52) U.S. Cl.

CPC ..... *F24F 13/06* (2013.01); *F24F 7/10* (2013.01); *F24F 2011/0006* (2013.01); *F24F 2221/38* (2013.01); *F24F 2221/46* (2013.01)

(58) Field of Classification Search

CPC ..... F24F 7/10; F24F 13/065; F24F 2221/38; F24F 2221/46

(Continued)

(56) References Cited

U.S. PATENT DOCUMENTS 3,537,380 A * 11/1970 Spradling et al. ..... F24F 11/053 236/49.4

3,933,306 A 1/1976 Nielsen (Continued)

FOREIGN PATENT DOCUMENTS

EP 0446557 B1 9/1991
EP 1 800 918 A1 6/2007

(Continued)

OTHER PUBLICATIONS

English Machine Translation of EP-0446557B1, Sep. 1991.*

(Continued)

*Primary Examiner* — Gregory Huson
*Assistant Examiner* — Dana Tighe
(74) *Attorney, Agent, or Firm* — Myers Bigel P.A.

(57) ABSTRACT

An air diffuser comprising at least one discharge that is hand manipulable to vary at least two of the airflow rate, the airflow pattern and the airflow direction, wherein the airflow pattern produced by the discharge element may be at least one of a substantially perpendicular axial swirl pattern relative to the discharge element surface or a substantially inclined swirl pattern relative to the perpendicular axis of the discharge element surface.

19 Claims, 30 Drawing Sheets

(58) Field of Classification Search
USPC ..... 454/289, 290, 297, 300, 308, 310, 312,454/313, 317, 324
See application file for complete search history.

(56) References Cited

U.S. PATENT DOCUMENTS

| | | | | |
|---|---|---|---|---|
| 4,154,149 | A | 5/1979 | Holford | |
| 5,556,330 | A | 9/1996 | Schweikert | |
| 5,569,078 | A * | 10/1996 | Kirkpatrick | F24F 13/072 454/292 |
| 5,938,525 | A | 8/1999 | Birdsong | |
| 6,050,892 | A * | 4/2000 | Sodec | 454/289 |
| 6,083,100 | A | 7/2000 | Hardy et al. | |
| 6,231,438 | B1 | 5/2001 | Laudermilk | |
| 6,302,784 | B1 * | 10/2001 | Berger | F24F 13/02 454/289 |
| 6,533,655 | B2 | 3/2003 | Demerath et al. | |
| 6,997,389 | B2 * | 2/2006 | Demster | 236/46 R |
| 2002/0081965 | A1 | 6/2002 | Demerath et al. | |
| 2006/0096198 | A1 * | 5/2006 | Kmet et al. | 52/234 |
| 2009/0061757 | A1 * | 3/2009 | Rimmer et al. | 454/290 |

FOREIGN PATENT DOCUMENTS

| | | |
|---|---|---|
| EP | 1 911 616 A1 | 4/2008 |
| EP | 1 923 242 A1 | 5/2008 |
| JP | 63-196039 | 12/1988 |
| JP | 01-160249 | 11/1989 |
| JP | 04-39630 | 4/1992 |
| JP | 04-97245 | 8/1992 |
| JP | 2004-205080 | 7/2004 |
| WO | WO 2005/021301 A1 | 3/2005 |

OTHER PUBLICATIONS

Office Action corresponding to Japanese Patent Application No. 2011-541025; Mailing date: Jul. 30, 2013; 5 pages.

Office Action corresponding to Chinese Patent Application No. 200980157186.9 Dated Jul. 1, 2013; 19 pages.

Memo Concerning the Official Action Reported in the Covering Letter, Mexican Patent Application No. MX/a/2011/006702, Aug. 24, 2015.

Patent Examination Report No. 1, Australian Patent Application No. 2009328656, Oct. 9, 2015, 3 pages.

* cited by examiner a) Directional Swirl with Manually Adjustable Airflow Rate
b) Radial Swirl with Manually Adjustable Airflow Rate

*a) Directional-Radial Adjustment with Preset or Electrically Adjustable Airflow Rate*
*b) Radial Swirl with Manually Adjustable Airflow Rate* i
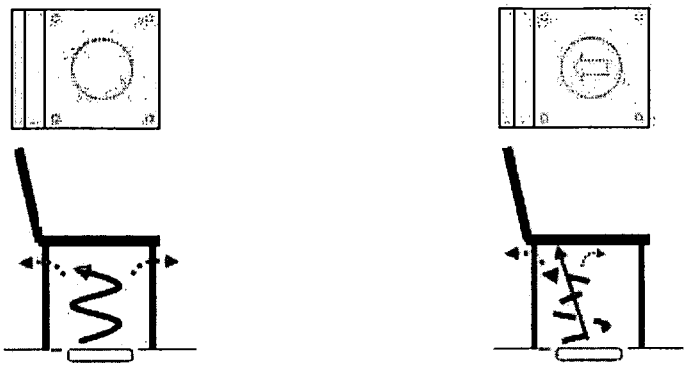
a) Prior Art: Auditorium Floor Swirl
- *Draught threat in leg region*
b) Invention: Auditorium Floor Swirl
- *Reduced draught threat in leg region:*
- *Airflow rate stops selectable*
ii
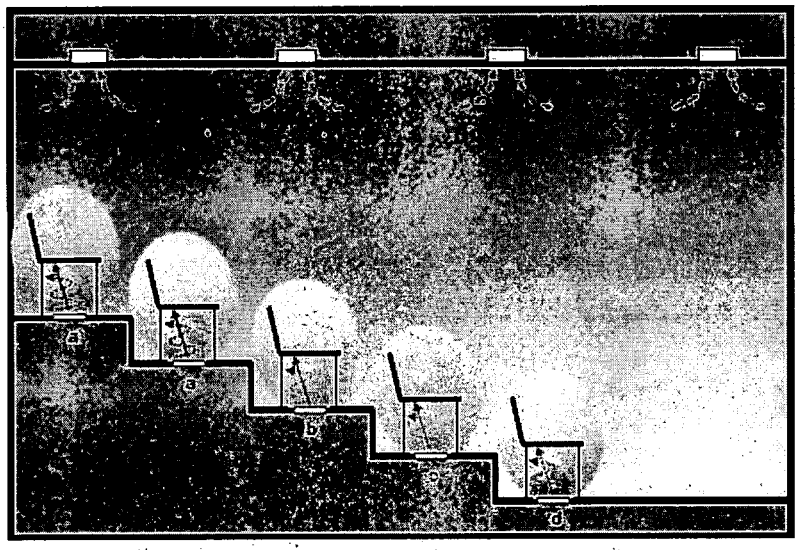
a Maximum airflow rate – maximum cooling
b High airflow rate – high cooling
c Medium airflow rate – medium cooling
d Low airflow rate – low cooling
Fig 3

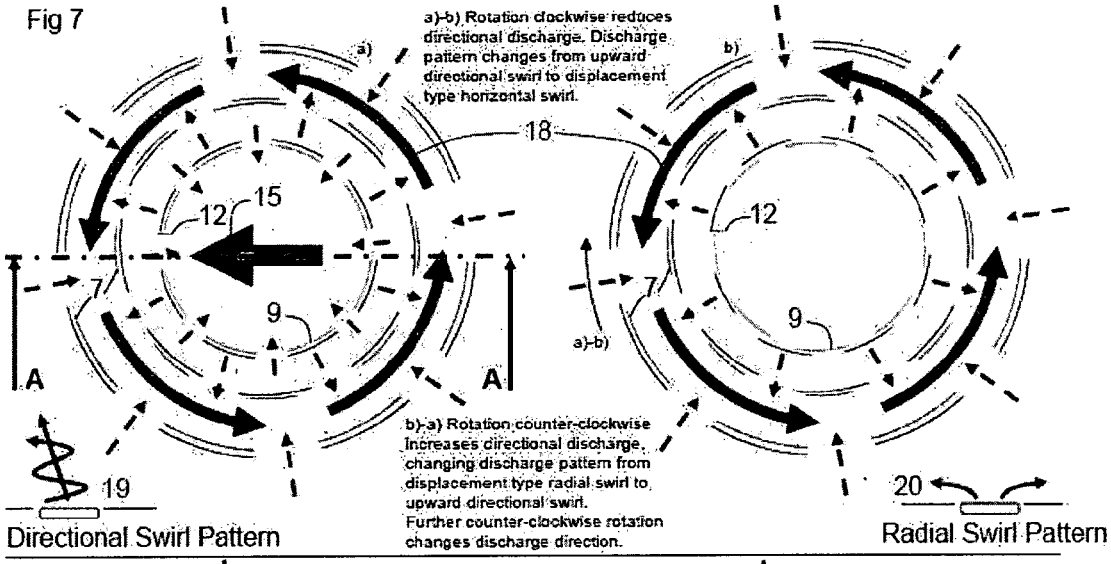
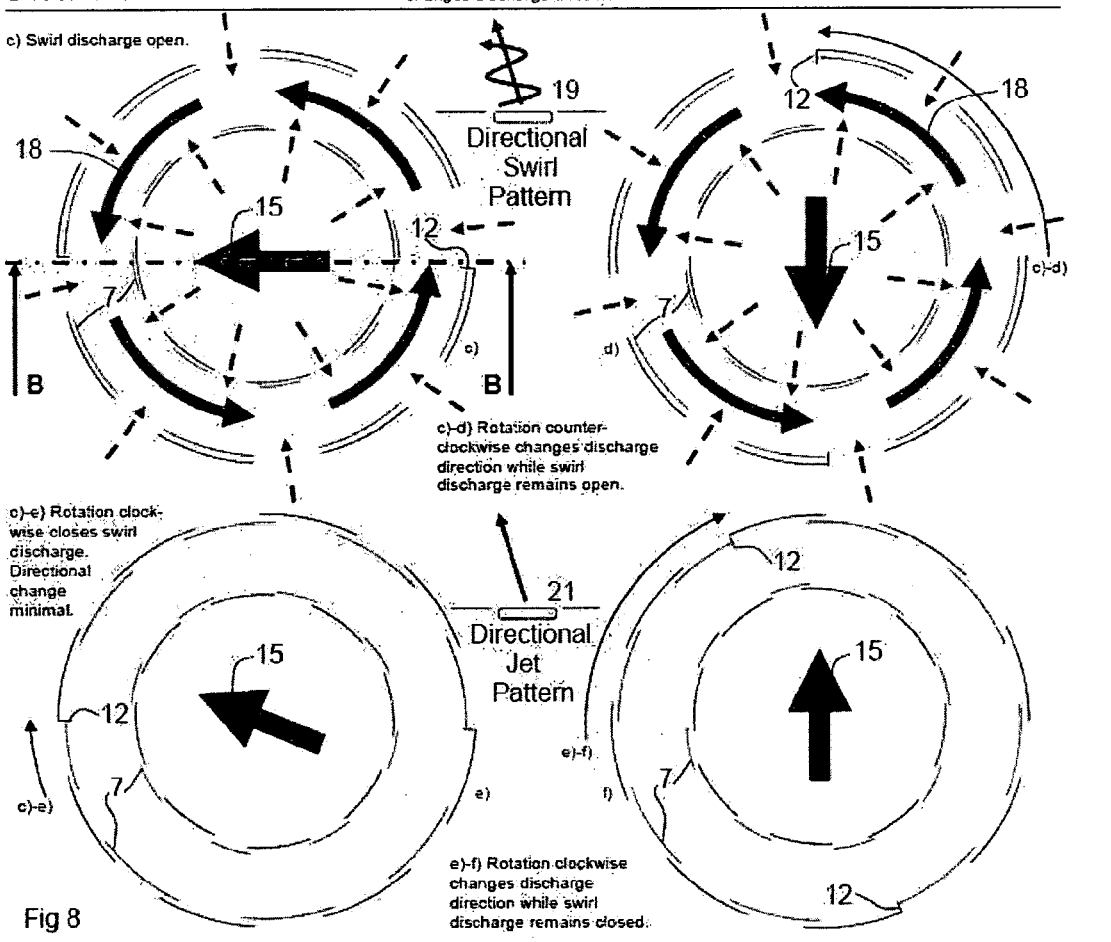
Fig 8

Fig 9

Configuration: Directional–Radial Adjustment

Directional damper adjustment range: *"Closed – Fully Open"*

| Preset Damper | 1st Airflow Rate, Pattern & Direction | Initial Discharge Element Rotation | 2nd Airflow Rate, Pattern & Direction | Further Discharge Element Rotation | 3rd Airflow Rate, Pattern & Direction |
|---|---|---|---|---|---|
| 1a) Swirl Damper fully open | • Airflow rate *maximum*<br>• *Directional* swirl pattern | Clockwise rotation | • Airflow rate *high*<br>• *Radial* swirl pattern | Clockwise rotation | • Airflow rate *high*<br>• *Radial* swirl pattern |
| | • Airflow rate *high*<br>• *Radial* swirl pattern | Counter-clockwise rotation | • Airflow rate *maximum*<br>• *Directional* swirl pattern | Counter-clockwise rotation | • Airflow rate *maximum*<br>• *Directional* swirl pattern<br>• Discharge direction *rotated* |
| 1b) Swirl Damper partially open | • Airflow rate *medium*<br>• *Directional* swirl pattern | Clockwise rotation | • Airflow rate *low*<br>• *Radial* swirl pattern | Clockwise rotation | • Airflow rate *low*<br>• *Radial* swirl pattern |
| | • Airflow rate *low*<br>• *Radial* swirl pattern | Counter-clockwise rotation | • Airflow rate *medium*<br>• *Directional* swirl pattern | Counter-clockwise rotation | • Airflow rate *medium*<br>• *Directional* swirl pattern<br>• Discharge direction *rotated* |
| 1c) Swirl Damper closed | • Airflow rate *minimum*<br>• *Directional* swirl pattern | Clockwise rotation | • Airflow rate *0*<br>• *Radial* swirl pattern | Clockwise rotation | • Airflow rate *0*<br>• *Radial* swirl pattern |
| | • Airflow rate *0*<br>• *Radial* swirl pattern | Counter-clockwise rotation | • Airflow rate *minimum*<br>• *Directional* swirl pattern | Counter-clockwise rotation | • Airflow rate *minimum*<br>• *Directional* swirl pattern<br>• Discharge direction *rotated* |

Tabulated Airflow Rate Scale: *0, Minimum, Low, Medium, High, Maximum*

Fig 10

Configuration: Directional Swirl

Swirl damper adjustment range: *"Closed – Fully Open"*

| Preset Damper | 1st Airflow Rate, Pattern & Direction | Initial Discharge Element Rotation | 2nd Airflow Rate, Pattern & Direction | Further Discharge Element Rotation | 3rd Airflow Rate, Pattern & Direction |
|---|---|---|---|---|---|
| 2) Directional Damper fully open | • Airflow rate *maximum*<br>• *Directional* swirl pattern | Clockwise rotation | • Airflow rate *minimum*<br>• *Directional* swirl pattern | Clockwise rotation | • Airflow rate *minimum*<br>• *Directional* swirl pattern<br>• Discharge direction *rotated* |
| | • Airflow rate *minimum*<br>• *Directional* swirl pattern | Counter-clockwise rotation | • Airflow rate *maximum*<br>• *Directional* swirl pattern | Counter-clockwise rotation | • Airflow rate *maximum*<br>• *Directional* swirl pattern<br>• Discharge direction *rotated* |

Tabulated Airflow Rate Scale: *0, Minimum, Low, Medium, High, Maximum*

Fig 11

Configuration: Radial Swirl

Swirl damper adjustment range: *"Closed – Fully Open"*

| Preset Damper | 1st Airflow Rate, Pattern & Direction | Initial Discharge Element Rotation | 2nd Airflow Rate, Pattern & Direction | Further Discharge Element Rotation | 3rd Airflow Rate, Pattern & Direction |
|---|---|---|---|---|---|
| 3) Directional Damper closed | • Airflow rate *high*<br>• *Radial* swirl pattern | Clockwise rotation | • Airflow rate *0*<br>• *Radial* swirl pattern | Clockwise rotation | • Airflow rate *0*<br>• *Radial* swirl pattern |
| | • Airflow rate *0*<br>• *Radial* swirl pattern | Counter-clockwise rotation | • Airflow rate *high*<br>• *Radial* swirl pattern | Counter-clockwise rotation | • Airflow rate *high*<br>• *Radial* swirl pattern |

Tabulated Airflow Rate Scale: *0, Minimum, Low, Medium, High, Maximum*

Configuration: Directional Swirl

Swirl damper stops: *Min; Low; Med; High; Max; Min-Med; Med-Max; or Min-Max*

Fig 18

Configuration: Directional Swirl

Swirl damper stops: *Min, Low, Med, High, Max; Min-Med; Med-Max; or Min-Max*

Occupant airflow rate adjustability (stop dependent) tabulated as *"increased"* or *"reduced"*

| 1st Airflow Rate, Pattern & Direction | Initial Discharge Element Rotation | 2nd Airflow Rate, Pattern & Direction | Further Discharge Element Rotation | 3rd Airflow Rate, Pattern & Direction |
|---|---|---|---|---|
| • Airflow rate *increased*<br>• *Directional* swirl pattern | Clockwise rotation | • Airflow rate *reduced*<br>• *Directional* swirl pattern | Clockwise rotation | • Airflow rate *reduced*<br>• *Directional* swirl pattern |

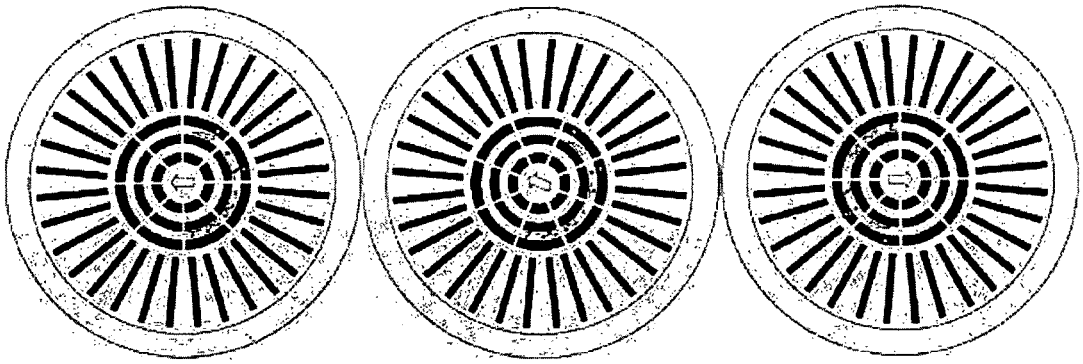

| | | | | |
|---|---|---|---|---|
| • Airflow rate *reduced*<br>• *Directional* swirl pattern | Counter-clockwise rotation | • Airflow rate *increased*<br>• *Directional* swirl pattern | Counter-clockwise rotation | • Airflow rate *increased*<br>• *Directional* swirl pattern<br>• Discharge direction rotated |

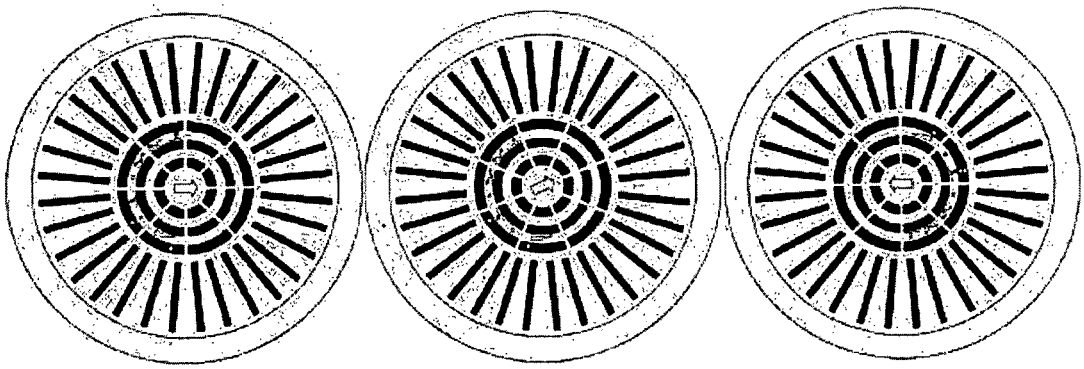

Configuration: Radial Swirl

Swirl damper stops: *Min; Low; Med; High; Max; Min-Med; Med-Max; or Min-Max*

Fig 20

Configuration: Radial Swirl

Swirl damper stops: *Min; Low; Med; High; Max; Min-Med; Med-Max; or Min-Max*

Occupant airflow rate adjustability (stop dependent) tabulated as *"increased"* or *"reduced"*

| 1st Airflow Rate, Pattern & Direction | Initial Discharge Element Rotation | 2nd Airflow Rate, Pattern & Direction | Further Discharge Element Rotation | 3rd Airflow Rate, Pattern & Direction |
|---|---|---|---|---|
| • Airflow rate *increased*<br>• *Radial* swirl pattern | Clockwise rotation | • Airflow rate *reduced*<br>• *Radial* swirl pattern | Clockwise rotation | • Airflow rate *reduced*<br>• *Radial* swirl pattern |

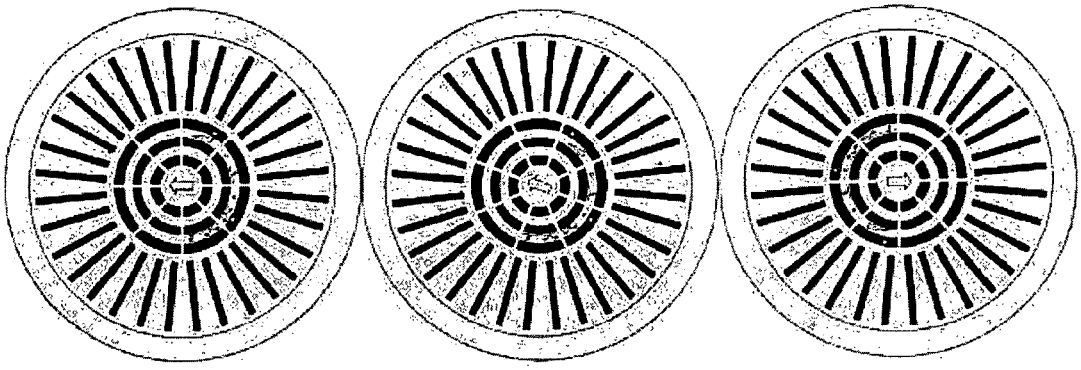

| | | | | |
|---|---|---|---|---|
| • Airflow rate *reduced*<br>• *Radial* swirl pattern | Counter-clockwise rotation | • Airflow rate *increased*<br>• *Radial* swirl pattern | Counter-clockwise rotation | • Airflow rate *increased*<br>• *Radial* swirl pattern |

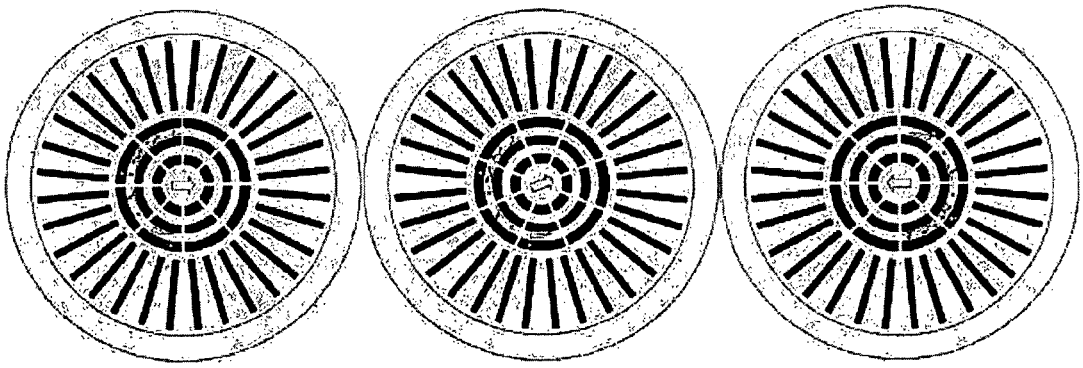

Fig 22

**Configuration: *Directional-Radial Adjustment***

Swirl damper stops: *Min; Low; Med; High; or Max*

Occupant airflow rate adjustability (stop dependent) tabulated as *"increased"* or *"reduced"*

| 1st Airflow Rate, Pattern & Direction | Initial Discharge Element Rotation | 2nd Airflow Rate, Pattern & Direction | Further Discharge Element Rotation | 3rd Airflow Rate, Pattern & Direction |
|---|---|---|---|---|
| • Airflow rate *increased*<br>• *Directional* swirl pattern | Clockwise rotation | • Airflow rate *reduced*<br>• *Radial* swirl pattern | Clockwise rotation | • Airflow rate *reduced*<br>• *Radial* swirl pattern |

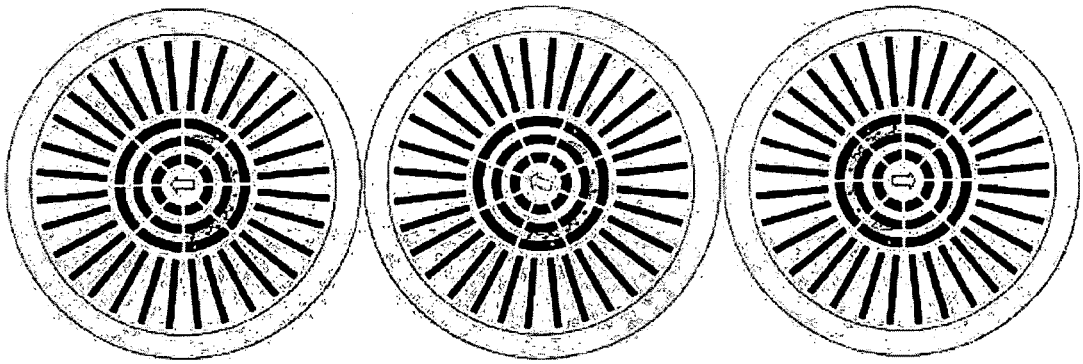

| | | | | |
|---|---|---|---|---|
| • Airflow rate *reduced*<br>• *Radial* swirl pattern | Counter-clockwise rotation | • Airflow rate *increased*<br>• *Directional* swirl pattern | Counter-clockwise rotation | • Airflow rate *increased*<br>• *Directional* swirl pattern<br>• Discharge direction *rotated* |

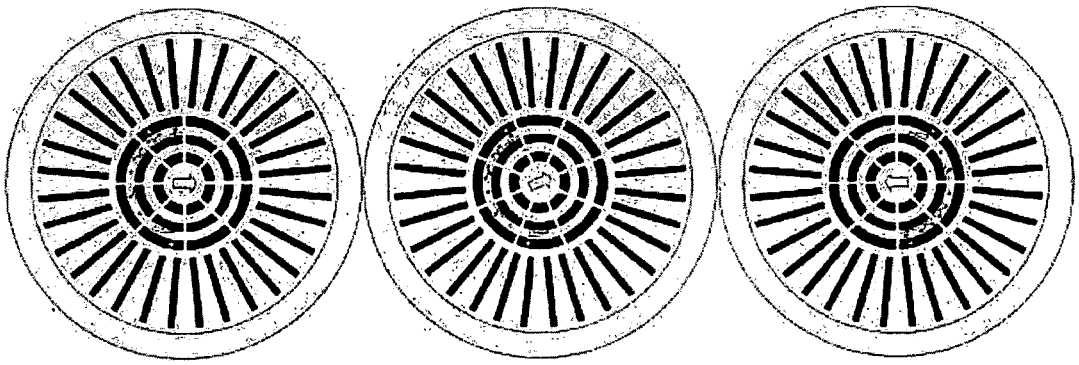

Configuration: *Electric Actuator Airflow Rate Adjustment*
Swirl damper stops: *Min-Max (damper operated by electric actuator)*

Fig 24

**Configuration: *Electric Actuator Airflow Rate Adjustment***

Swirl damper stops: *Min-Max (damper operated by electric actuator)*

Occupant airflow rate adjustability (stop dependent) tabulated as *"increased"* or *"reduced"*

| 1st Airflow Rate, Pattern & Direction | Initial Discharge Element Rotation | 2nd Airflow Rate, Pattern & Direction | Further Discharge Element Rotation | 3rd Airflow Rate, Pattern & Direction |
|---|---|---|---|---|
| • Airflow rate *increased*<br>• *Directional* swirl pattern | Clockwise rotation | • Airflow rate *reduced*<br>• *Radial* swirl pattern | Clockwise rotation | • Airflow rate *reduced*<br>• *Radial* swirl pattern |

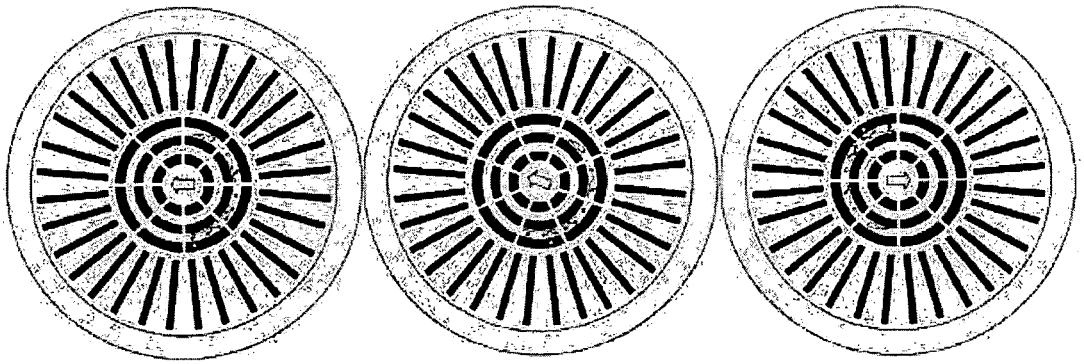

| | | | | |
|---|---|---|---|---|
| • Airflow rate *reduced*<br>• *Radial* swirl pattern | Counter-clockwise rotation | • Airflow rate *increased*<br>• *Directional* swirl pattern | Counter-clockwise rotation | • Airflow rate *increased*<br>• *Directional* swirl pattern<br>• Discharge direction *rotated* |

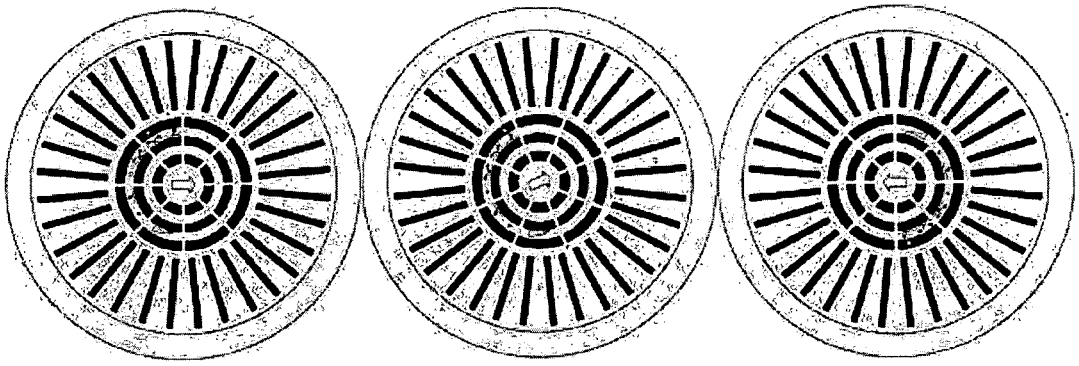

Configuration: Under-Seat Directional Swirl
Swirl damper stops: *Min, Low, Med, High or Max*

Fig 26
Configuration: Under-Seat Directional Swirl
Swirl damper stops: *Min, Low, Med, High or Max*
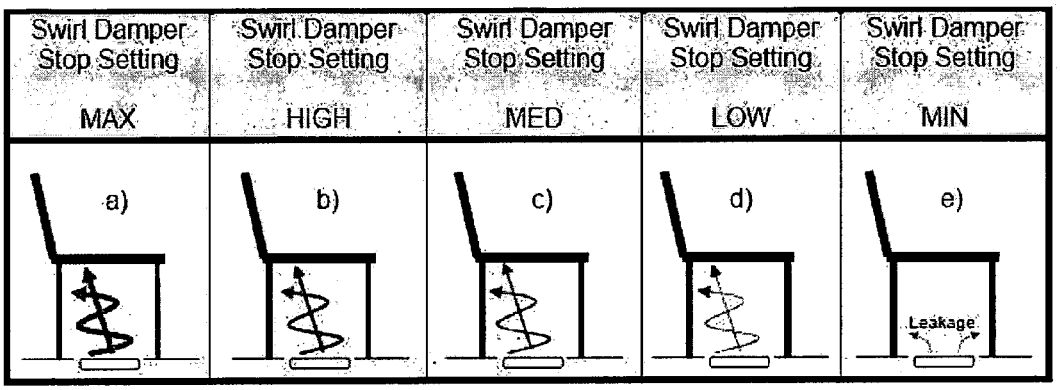
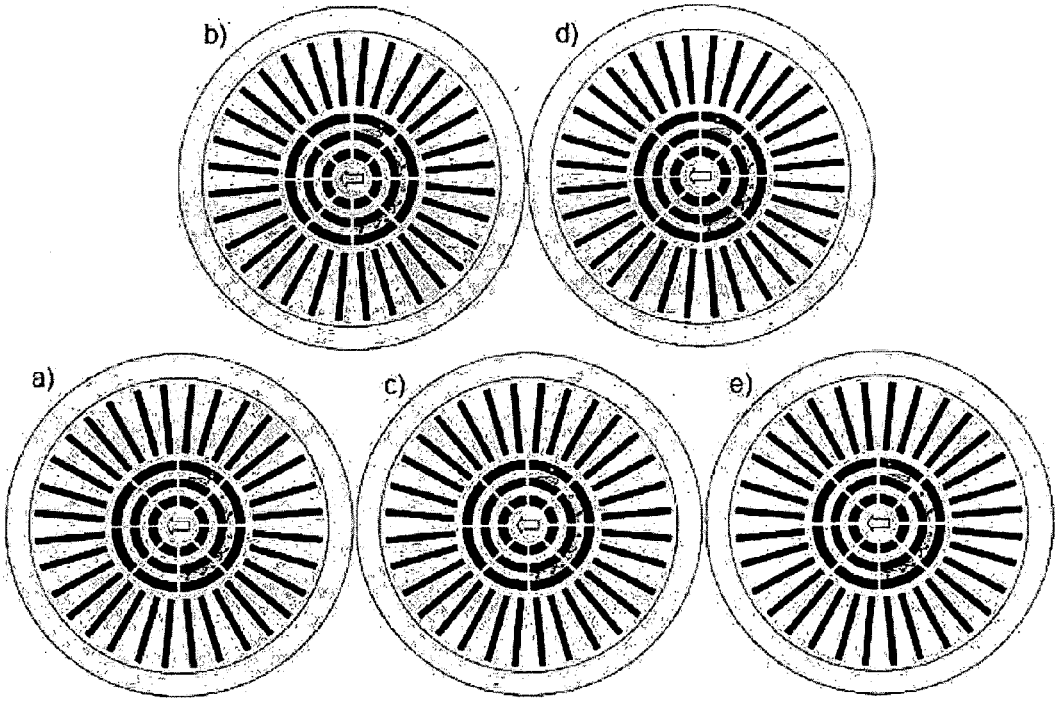

*a) Directional Swirl with Manually Adjustable Airflow Rate*
*b) Vertical Swirl with Manually Adjustable Airflow Rate*

*a) Directional-Vertical Adjustment with Preset or Electrically Adjustable Airflow Rate*
*b) Vertical Swirl with Manually Adjustable Airflow Rate*

Fig 29

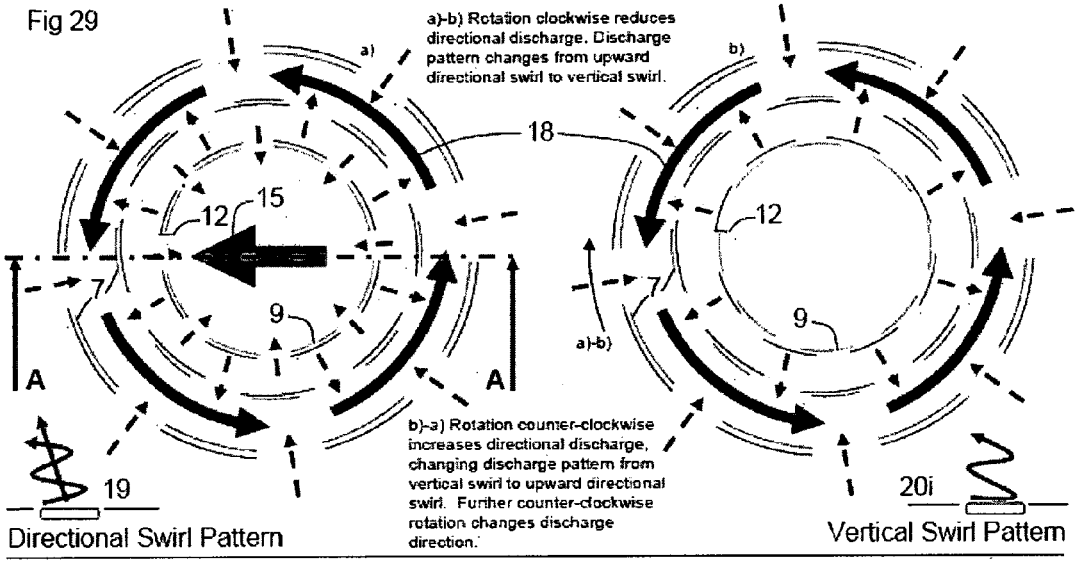

Fig 30

Configuration: Vertical Swirl

Swirl damper adjustment range: *"Closed – Fully Open"*

| Preset Damper | 1st Airflow Rate, Pattern & Direction | Initial Discharge Element Rotation | 2nd Airflow Rate, Pattern & Direction | Further Discharge Element Rotation | 3rd Airflow Rate, Pattern & Direction |
|---|---|---|---|---|---|
| 3) Directional Damper closed | • Airflow rate *high*<br>• *Vertical* swirl pattern | Clockwise rotation | • Airflow rate *0*<br>• *Vertical* swirl pattern | Clockwise rotation | • Airflow rate *0*<br>• *Vertical* swirl pattern |
| | • Airflow rate *0*<br>• *Vertical* swirl pattern | Counter-clockwise rotation | • Airflow rate *high*<br>• *Vertical* swirl pattern | Counter-clockwise rotation | • Airflow rate *high*<br>• *Vertical* swirl pattern |

Tabulated Airflow Rate Scale: *0, Minimum, Low, Medium, High, Maximum*

Fig 31

Configuration: Directional–Vertical Adjustment

Directional damper adjustment range: *"Closed – Fully Open"*

| Preset Damper | 1st Airflow Rate, Pattern & Direction | Initial Discharge Element Rotation | 2nd Airflow Rate, Pattern & Direction | Further Discharge Element Rotation | 3rd Airflow Rate, Pattern & Direction |
|---|---|---|---|---|---|
| 1a) Swirl Damper fully open | • Airflow rate *maximum*<br>• *Directional* swirl pattern | Clockwise rotation | • Airflow rate *high*<br>• *Vertical* swirl pattern | Clockwise rotation | • Airflow rate *high*<br>• *Vertical* swirl pattern |
| | • Airflow rate *high*<br>• *Vertical* swirl pattern | Counter-clockwise rotation | • Airflow rate *maximum*<br>• *Directional* swirl pattern | Counter-clockwise rotation | • Airflow rate *maximum*<br>• *Directional* swirl pattern<br>• Discharge direction *rotated* |
| 1b) Swirl Damper partially open | • Airflow rate *medium*<br>• *Directional* swirl pattern | Clockwise rotation | • Airflow rate *low*<br>• *Vertical* swirl pattern | Clockwise rotation | • Airflow rate *low*<br>• *Vertical* swirl pattern |
| | • Airflow rate *low*<br>• *Vertical* swirl pattern | Counter-clockwise rotation | • Airflow rate *medium*<br>• *Directional* swirl pattern | Counter-clockwise rotation | • Airflow rate *medium*<br>• *Directional* swirl pattern<br>• Discharge direction *rotated* |
| 1c) Swirl Damper closed | • Airflow rate *minimum*<br>• *Directional* swirl pattern | Clockwise rotation | • Airflow rate *0*<br>• *Vertical* swirl pattern | Clockwise rotation | • Airflow rate *0*<br>• *Vertical* swirl pattern |
| | • Airflow rate *0*<br>• *Vertical* swirl pattern | Counter-clockwise rotation | • Airflow rate *minimum*<br>• *Directional* swirl pattern | Counter-clockwise rotation | • Airflow rate *minimum*<br>• *Directional* swirl pattern<br>• Discharge direction *rotated* |

Tabulated Airflow Rate Scale: *0, Minimum, Low, Medium, High, Maximum*

Fig 34

Configuration: Directional Swirl

Swirl damper stops: *Min; Low; Med; High; Max; Min-Med; Med-Max; or Min-Max*

Occupant airflow rate adjustability (stop dependent) tabulated as *"increased"* or *"reduced"*

| 1st Airflow Rate, Pattern & Direction | Initial Discharge Element Rotation | 2nd Airflow Rate, Pattern & Direction | Further Discharge Element Rotation | 3rd Airflow Rate, Pattern & Direction |
|---|---|---|---|---|
| • Airflow rate *increased*<br>• *Directional* swirl pattern | Clockwise rotation | • Airflow rate *reduced*<br>• *Directional* swirl pattern | Clockwise rotation | • Airflow rate *reduced*<br>• *Directional* swirl pattern |

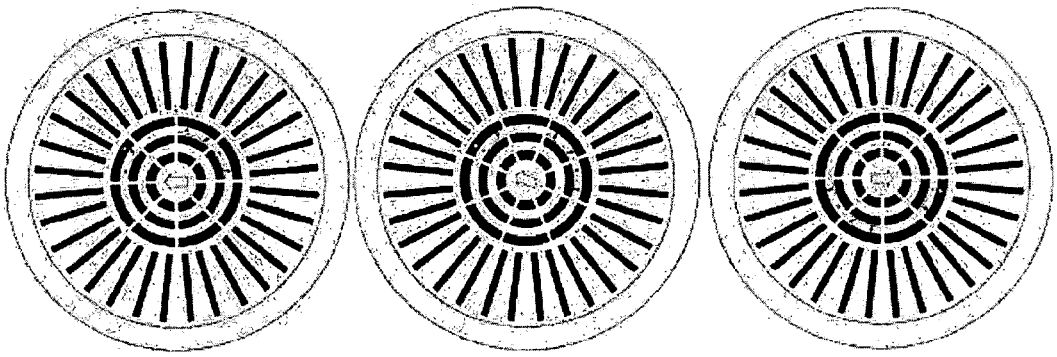

| | | | | |
|---|---|---|---|---|
| • Airflow rate *reduced*<br>• *Directional* swirl pattern | Counter-clockwise rotation | • Airflow rate *increased*<br>• *Directional* swirl pattern | Counter-clockwise rotation | • Airflow rate *increased*<br>• *Directional* swirl pattern<br>• Discharge direction *rotated* |

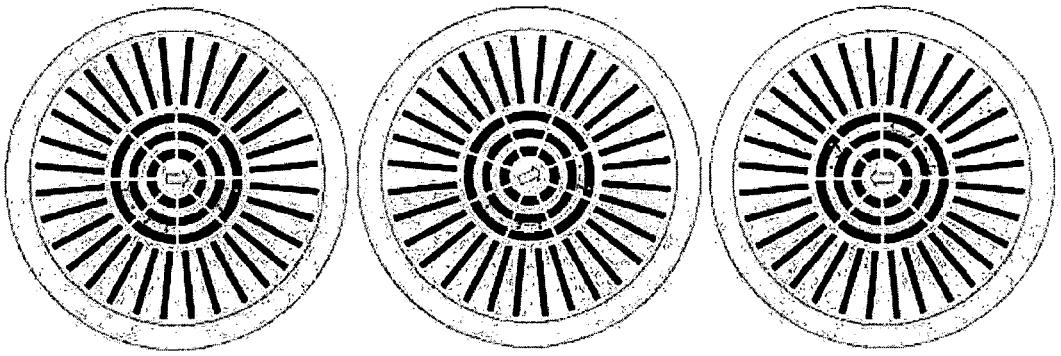

Fig 35

Configuration: Vertical Swirl

Swirl damper stops: *Min; Low; Med; High, Max; Min-Med; Med-Max; or Min-Max*

Occupant airflow rate adjustability (stop dependent) tabulated as *"increased"* or *"reduced"*

| 1st Airflow Rate, Pattern & Direction | Initial Discharge Element Rotation | 2nd Airflow Rate, Pattern & Direction | Further Discharge Element Rotation | 3rd Airflow Rate, Pattern & Direction |
|---|---|---|---|---|
| • Airflow rate *increased*<br>• *Vertical* swirl pattern | Clockwise rotation | • Airflow rate *reduced*<br>• *Vertical* swirl pattern | Clockwise rotation | • Airflow rate *reduced*<br>• *Vertical* swirl pattern |

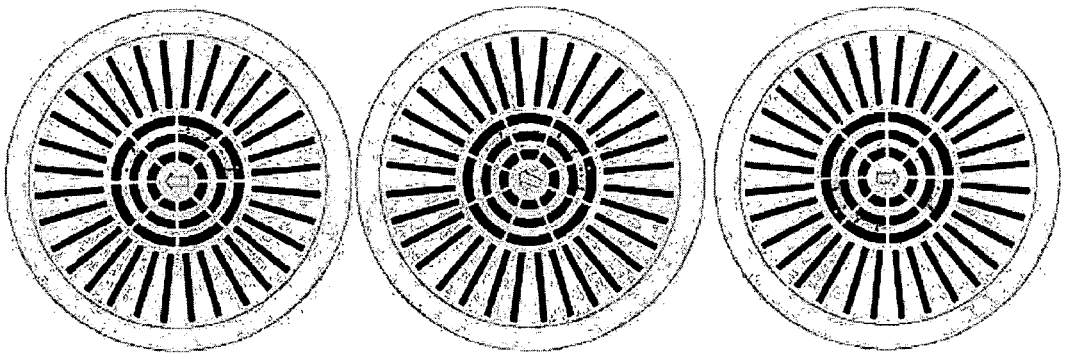

| | | | | |
|---|---|---|---|---|
| • Airflow rate *reduced*<br>• *Vertical* swirl pattern | Counter-clockwise rotation | • Airflow rate *increased*<br>• *Vertical* swirl pattern | Counter-clockwise rotation | • Airflow rate *increased*<br>• *Vertical* swirl pattern |

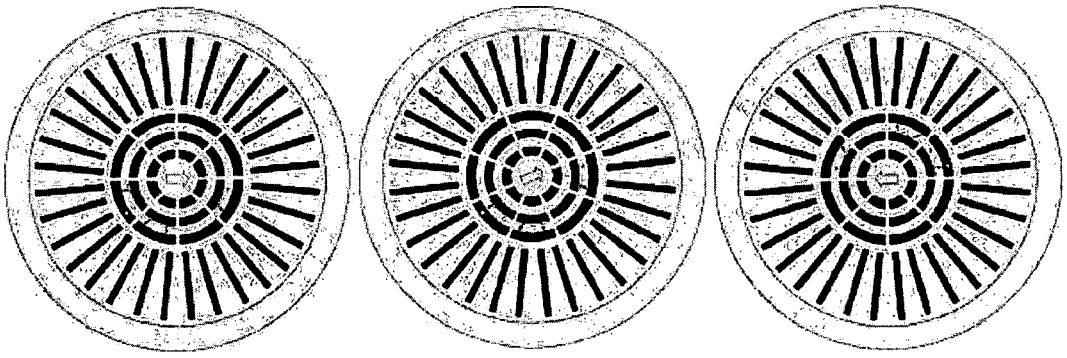

Fig 36

**Configuration: Directional-Vertical *or* Electric Actuator Airflow Rate Adjustment**

Directional-vertical swirl damper stops: *Min, Low, Med, High, or Max*

Electric actuator swirl damper stops: *Min-Max (damper operated by electric actuator)*

Occupant airflow rate adjustability (stop dependent) tabulated as *"increased"* or *"reduced"*

| 1st Airflow Rate, Pattern & Direction | Initial Discharge Element Rotation | 2nd Airflow Rate, Pattern & Direction | Further Discharge Element Rotation | 3rd Airflow Rate, Pattern & Direction |
|---|---|---|---|---|
| • Airflow rate *increased*<br>• *Directional* swirl pattern | Clockwise rotation | • Airflow rate *reduced*<br>• *Radial* swirl pattern | Clockwise rotation | • Airflow rate *reduced*<br>• *Radial* swirl pattern |

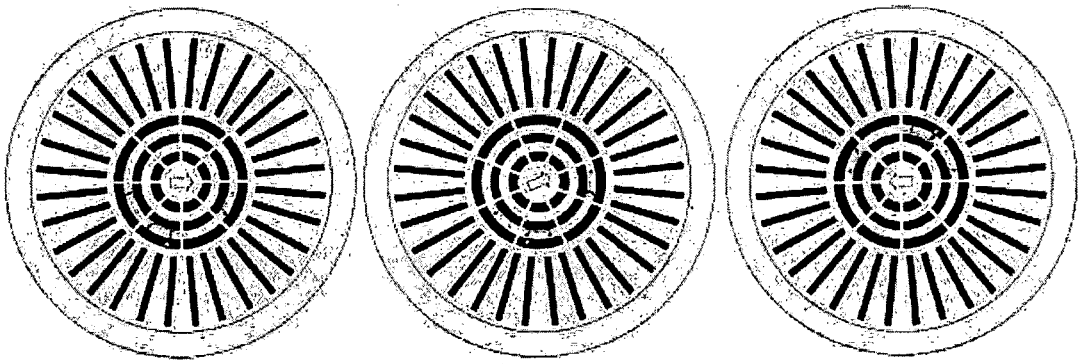

| | | | | |
|---|---|---|---|---|
| • Airflow rate *reduced*<br>• *Radial* swirl pattern | Counter-clockwise rotation | • Airflow rate *increased*<br>• *Directional* swirl pattern | Counter-clockwise rotation | • Airflow rate *increased*<br>• *Directional* swirl pattern<br>• Discharge direction *rotated* |

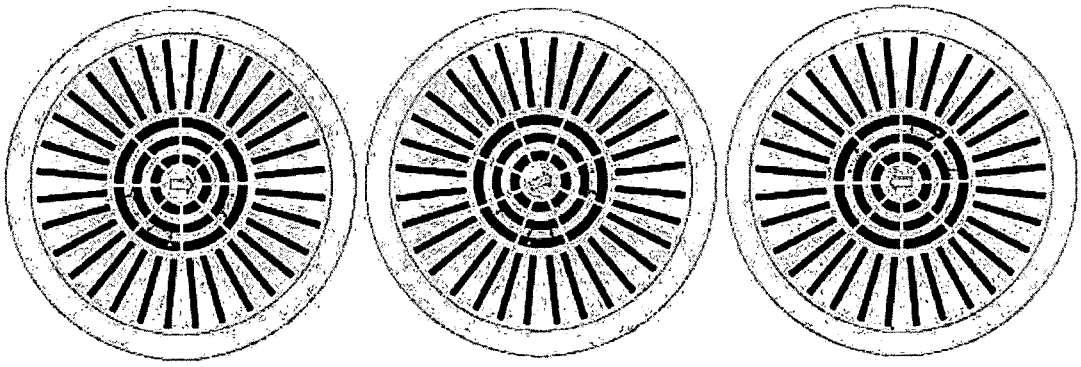

AIR DIFFUSER AND AIR CIRCULATION SYSTEM

RELATED APPLICATION

This application is a 35 U.S.C. §371 national stage application of PCT Application No. PCT/AU2009/001654, filed on 18 Dec. 2009, which claims priority from Australian Patent Application No. 2008906547, filed 19 Dec. 2008, the contents of which are incorporated herein by reference in their entireties. The above-references PCT International Application wa published in the English language as International Publication No. WO 2010/069001 A1 on 24 Jun. 2010.

FIELD OF THE INVENTION

The present invention relates to an air diffuser. Embodiments of the invention find particular, but not exclusive, use as a floor diffuser in a raised access floor into which an air supply or air delivery system has been installed.

BACKGROUND OF THE INVENTION

Many buildings contain raised access floor systems, which allow power and data communications wiring to be located in the floor plenum below the access floor. This cavity may also be used as an underfloor air delivery system for the supply of conditioned air to the occupancy space above. Air is typically delivered from the air delivery system to the occupancy space via one or more floor diffusers, and air may be removed from the space from a high level. Known diffusers, however, may not provide sufficient airflow patterns, air pattern adjustment and airflow rate adjustment to maximise user comfort and minimise air conditioning energy consumption.

SUMMARY OF THE INVENTION

In a first aspect, the present invention provides an air diffuser comprising at least one discharge element that is hand manipulable to vary at least two of the airflow rate, the airflow pattern and the airflow direction.

The airflow pattern produced by the discharge element may be at least one of a substantially inclined swirl pattern relative to the perpendicular axis of the discharge element surface, a substantially perpendicular axial swirl pattern relative to the discharge element surface, and a substantially parallel radial swirl pattern relative to the discharge element surface.

In one embodiment, the discharge element is rotatable about a substantially perpendicular axis relative to the discharge element surface.

The airflow pattern may be alterable between the substantially inclined swirl pattern and the substantially parallel radial swirl pattern or between the substantially inclined swirl pattern and the substantially perpendicular axial swirl pattern.

Rotation of the discharge element about an axis substantially perpendicular to the surface of the discharge element may vary the airflow rate discharged by the diffuser.

The discharge element may maintain a substantially constant perpendicular throw irrespective of diffuser airflow rate adjustment.

Rotation of the discharge element about a substantially perpendicular axis relative to the surface of the element may change the airflow pattern from a substantially parallel displacement type radial swirl pattern, or from a substantially perpendicular axial swirl pattern, to a substantially unidirectional swirl pattern inclined relative to the perpendicular axis of the discharge element.

The airflow pattern may be varied as the airflow rate is adjusted by a user.

The diffuser may further include a mounting element arranged to be secured in a floor, step, wall or ceiling penetration and the discharge element may be located within the mounting element.

The discharge element may include a central portion arranged to discharge an air jet in substantially perpendicular to the discharge element surface, wherein the central portion may be substantially circular.

The air jet may be inclined substantially in one direction to the perpendicular axis relative to the discharge element surface.

The discharge element may further comprise a discharge portion arranged to discharge a swirl pattern of air, wherein the discharge portion may substantially surround the central portion.

A collecting basket arranged to collect detritus may be provided.

The collecting basket air inlets may be arranged to reduce the restriction of airflow into the collecting basket from a penetration or duct into which the diffuser mounting ring may be installed.

The collecting basket surfaces with air inlet openings may be of a substantially sawtooth shape.

The collecting basket may include two chambers and may be located in the mounting element.

One of the two chambers may be substantially circular and may be substantially located upstream of the jet discharge portion of the discharge element.

One of the two chambers may be substantially annular and may be substantially located upstream of the swirl discharge portion of the discharge element.

At least one of the chambers may be fitted with a damper.

At least one of the dampers may include openings arranged in substantially conical or cylindrical surfaces about the axis perpendicular to the surface of the discharge element to effect opening and closure of the damper element through an arc of rotation about the perpendicular axis.

At least one of the dampers may be linked to the discharge element to effect opening and closure of the damper element through an arc of rotation of the discharge element about an axis perpendicular to the surface of the discharge element.

There may be provided damper stops that provide at least one of a plurality of fixed airflow rates and a selection of airflow rate ranges.

Embodiments may include an electric actuator mechanism arranged to electrically control airflow rates.

The diffuser may further comprise a fixed damper to reduce the airflow rate and throw.

The diffuser may include a duct connection portion arranged to receive a duct.

The diffuser may further include at least one visual feedback element arranged to indicate at least one of the airflow pattern, rate and direction of the diffuser and/or arranged to indicate a diffuser configuration.

Embodiments may include a discharge element lock arranged to prevent unauthorised access into the diffuser by a user.

There may be provided at least one fixed or removable locking element arranged to prevent the configuration of the diffuser from being altered.

The discharge element may only be engaged with a body portion of the diffuser when the discharge element is placed in a particular orientation relative to the body portion.

In one embodiment, the diffuser includes at least one removable orientation element securable in at least one of a plurality of locations.

The orientation element may also perform the functions of the locking element.

In a second aspect, the present invention provides a ducting system incorporating at least one air diffuser in accordance with the first aspect of the invention.

In a third aspect, the present invention provides an air supply system incorporating at least one air diffuser in accordance with the first aspect of the invention.

In a fourth aspect, the present invention provides a kit of parts including a discharge element arranged to manipulate the flow of air and a diffuser housing, wherein, in use, the discharge element is engageable with the diffuser having to provide at least one of a plurality of airflow rates, airflow patterns and airflow directions.

In a fifth aspect, the present invention provides a discharge element arranged to be engaged with a housing, wherein, in use, the discharge element is hand manipulatable to provide at least one of a plurality of airflow rates, airflow patterns and airflow directions.

DETAILED DESCRIPTION OF THE DRAWINGS

Notwithstanding any other forms which may fall within the scope of the present invention, a preferred embodiment will now be described, by way of example only, with reference to the accompanying drawings in which:

FIG. 3 is a diagram illustrating airflow patterns beneath auditorium seating with the prior art of upward symmetrical floor swirl, as well as directional floor swirl air patterns with a selection of preset airflow rates in accordance with the invention;

FIG. 7 is a diagram illustrating airflow rates, discharge patterns and discharge direction achieved when rotating the discharge element in the embodiment shown in FIG. 5;

FIG. 8 is a diagram illustrating airflow rates, discharge patterns and discharge direction options achieved when rotating the discharge element in the embodiment shown in FIG. 6;

FIG. 9 illustrates airflow patterns, direction and rate of an embodiment when configured for directional-radial pattern adjustment;

FIG. 10 illustrates airflow patterns, direction and rate of an embodiment when configured for a directional swirl pattern;

FIG. 11 illustrates airflow patterns, direction and rate of an embodiment when configured for a radial swirl pattern;

FIG. 18 illustrates airflow rate, direction and patterns of the embodiment shown in FIG. 16 configured for a directional swirl pattern with inclined axis;

FIG. 20 illustrates airflow rate, direction and pattern of the embodiment shown in FIG. 16 configured for a horizontally directed displacement type radial swirl pattern;

FIG. 22 illustrates airflow rate, direction and patterns of the embodiment shown in FIG. 16 configured for a directional-radial pattern adjustment;

FIG. 24 illustrates airflow rate, direction and patterns of the embodiment shown in FIG. 16 when configured for electric actuator airflow rate adjustment with manual directional-radial pattern adjustment;

Figure 5:
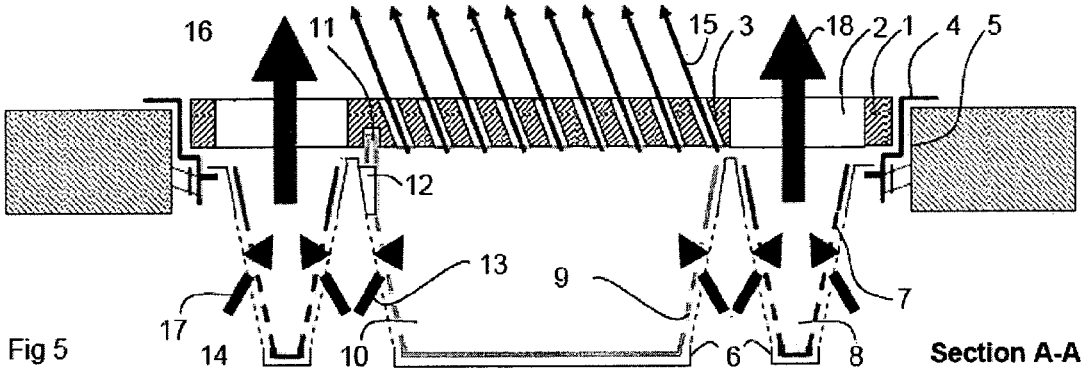
FIG. 5 is a diagram illustrating a section of a mounting ring inserted in a floor penetration in which a dirt collecting basket, housing two airflow dampers, is located beneath a circular discharge element.
Figure 16:
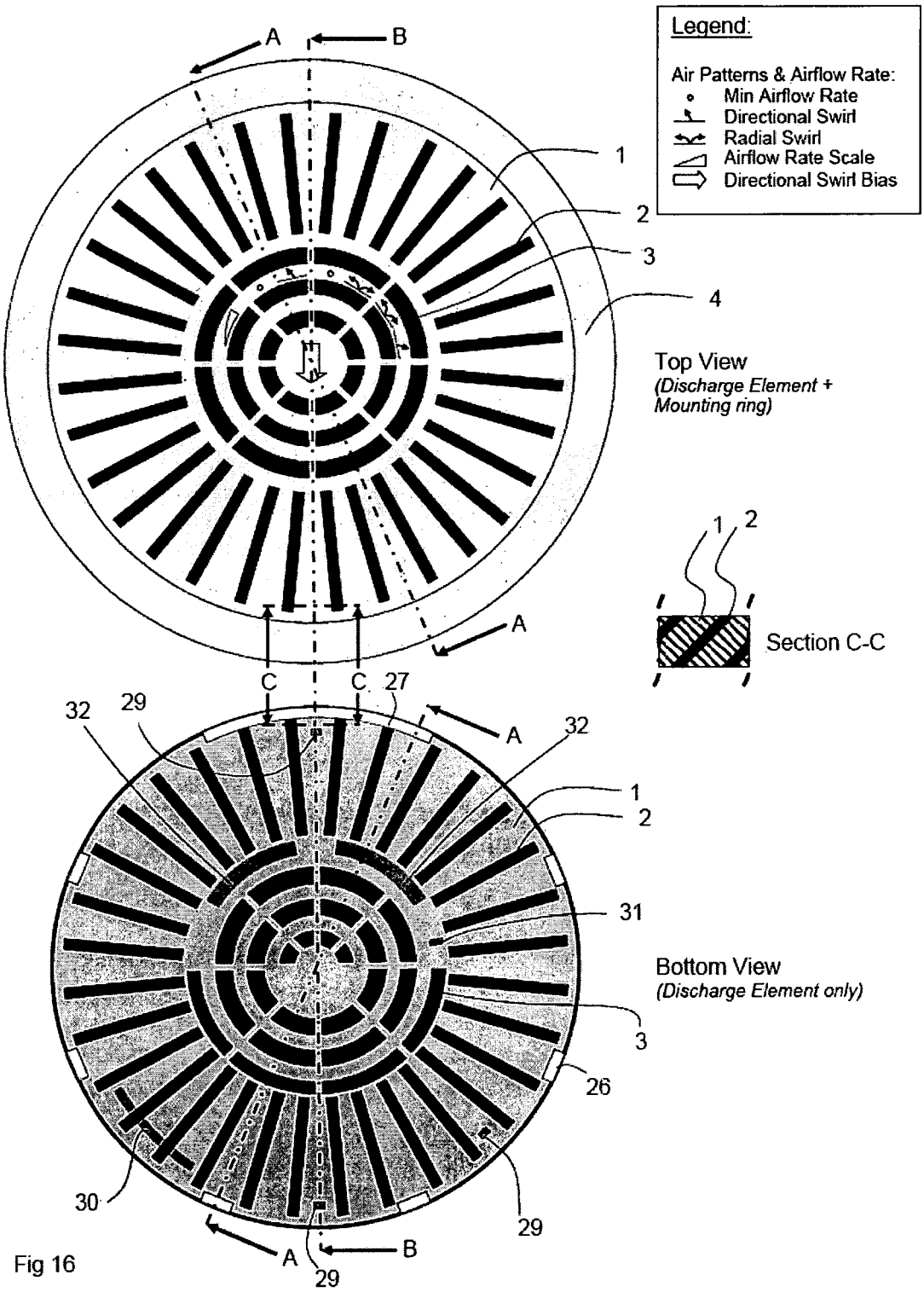
FIG. 16 is a diagram illustrating the discharge element and mounting ring of an embodiment of the invention offering directional swirl with an inclined axis and horizontally directed displacement type radial swirl patterns.
Figure 25:
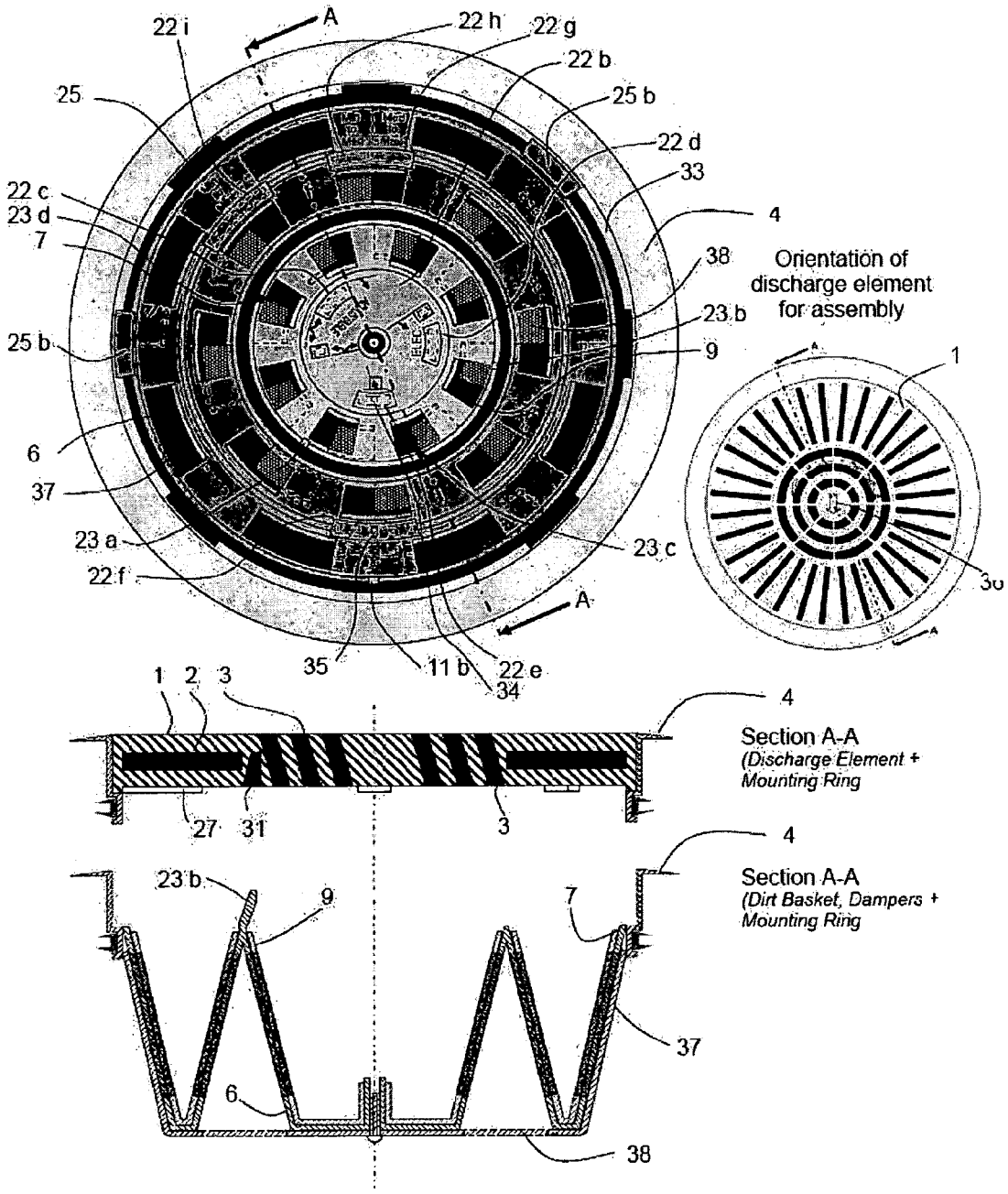
Figure 27:
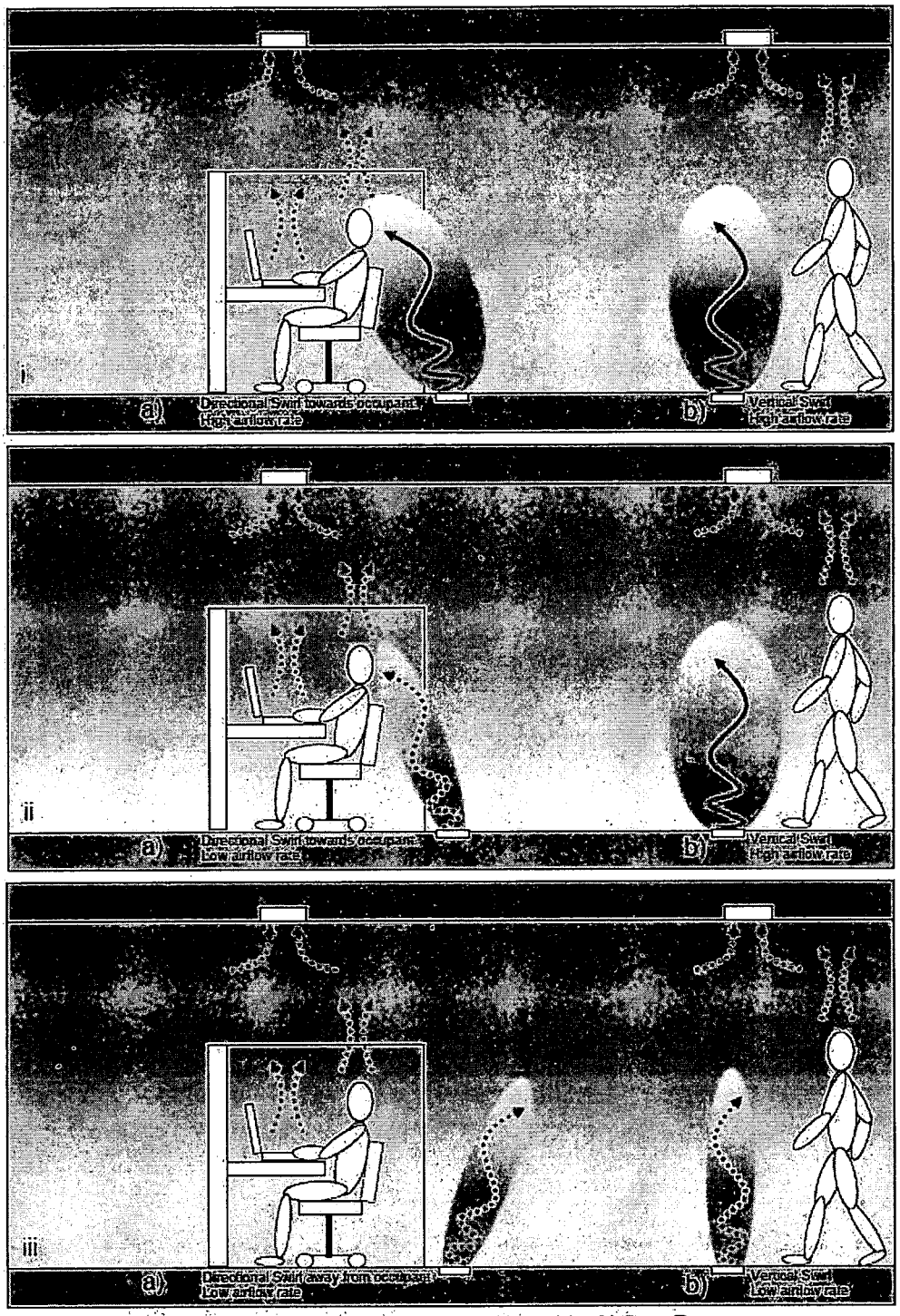
Figure 28:
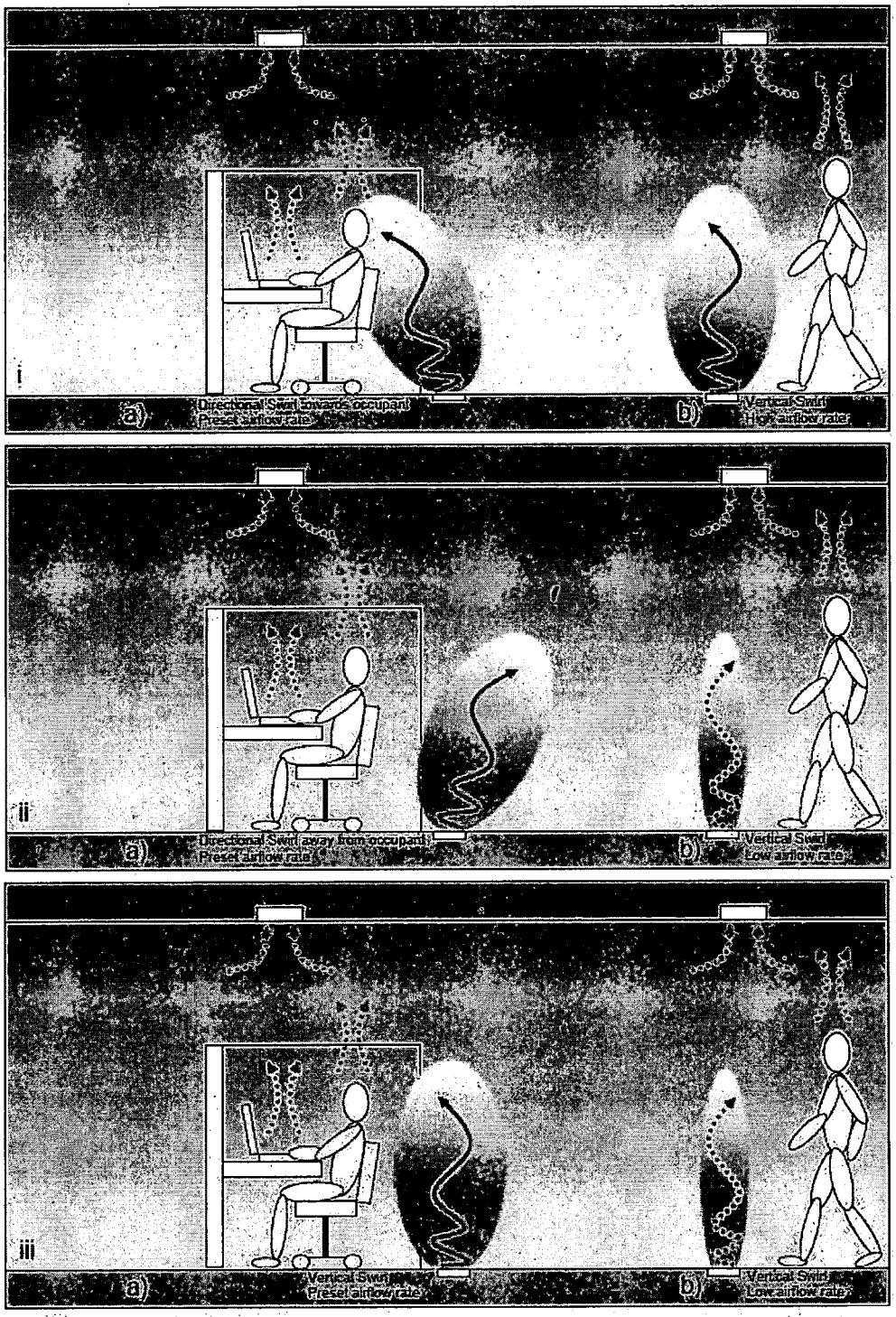
Figure 32:
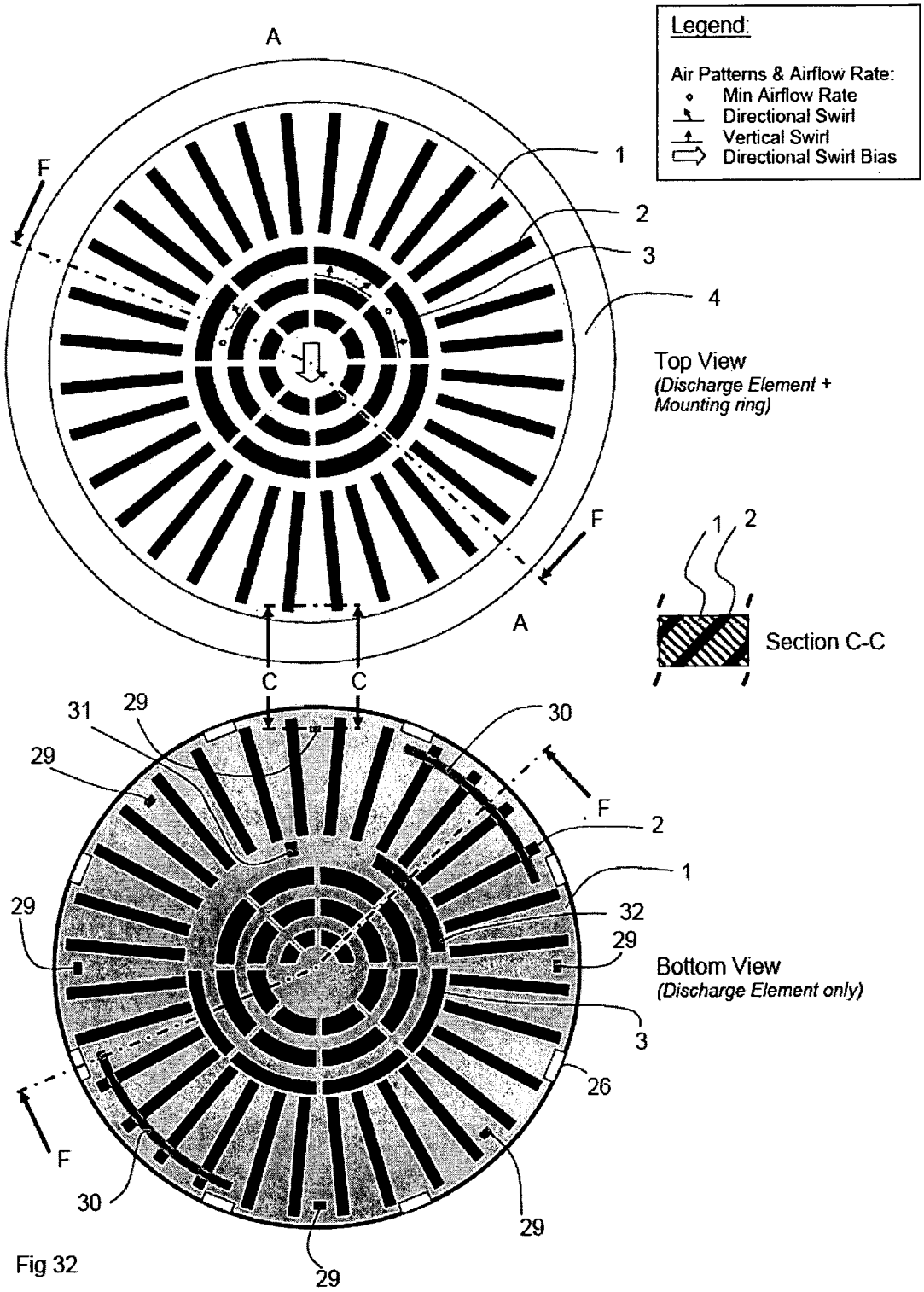
Figure 33:
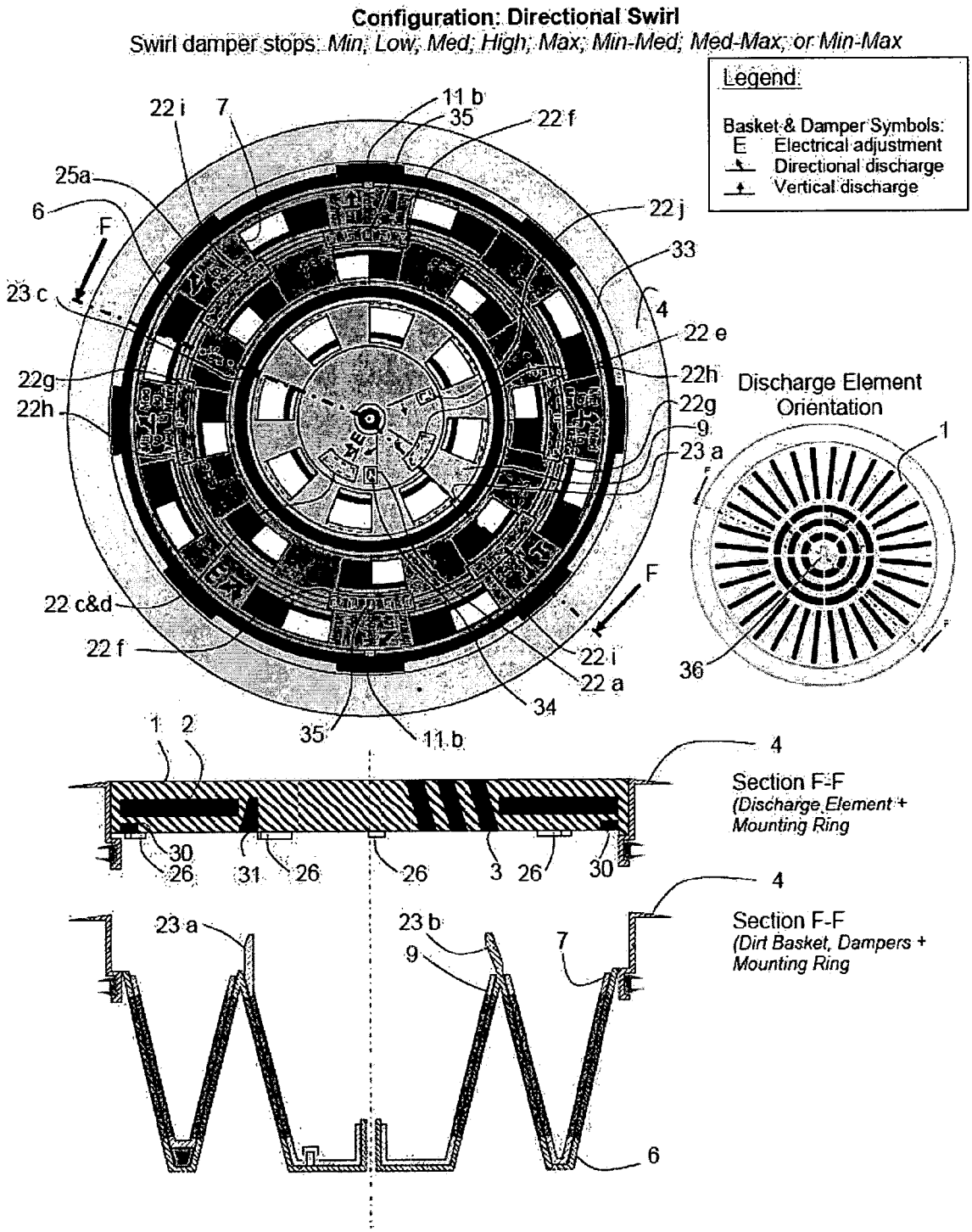
Figure 37:
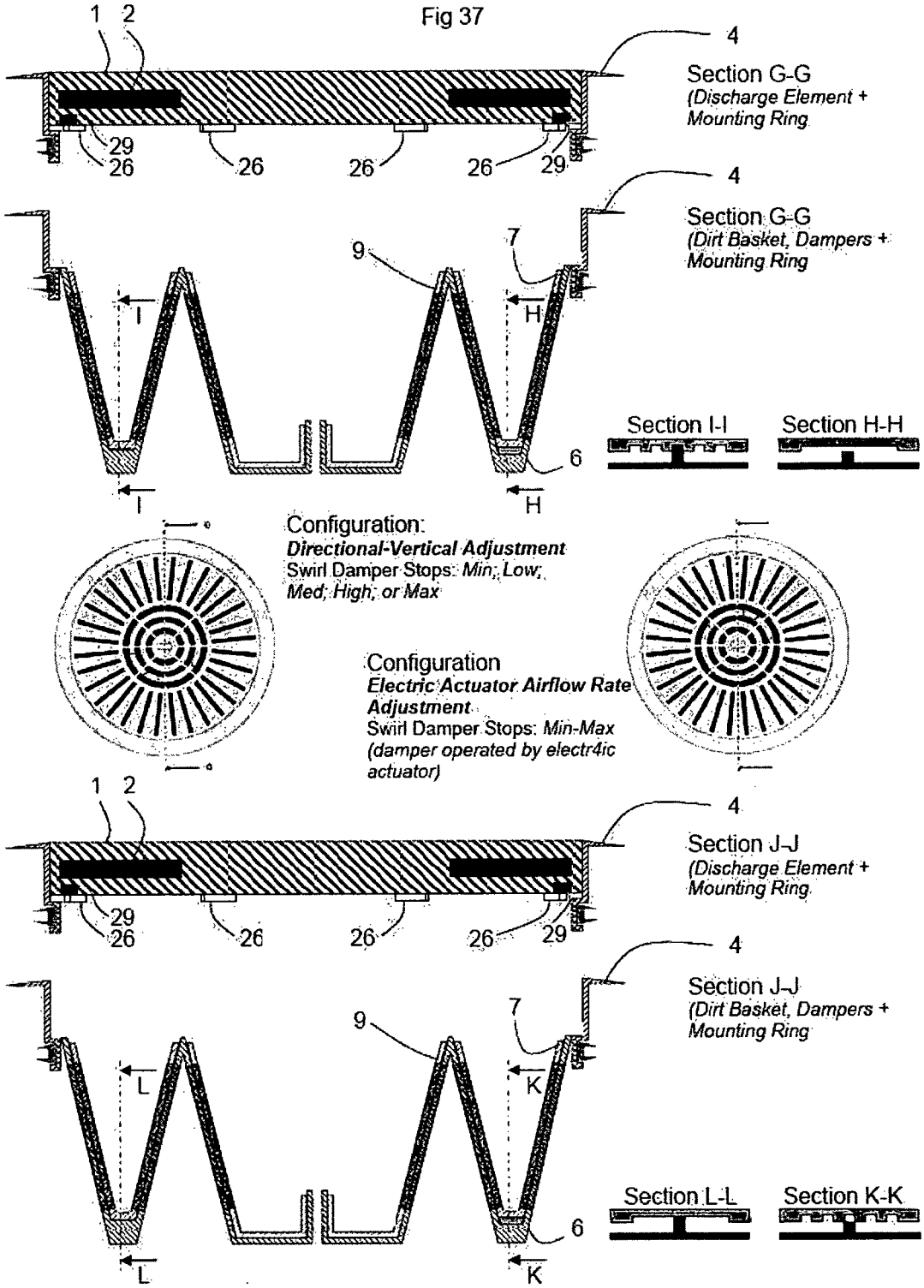

FIG. 25 is a diagram illustrating the mounting ring, dirt collecting basket, accessory damper-basket, swirl damper and directional damper orientation of the embodiment shown in FIG. 16 configured for air supply from beneath auditorium seating; and FIG. 26 illustrates airflow rate, direction and patterns of the embodiment shown in FIG. 25 when configured for directional swirl discharge with an inclined axis from beneath auditorium seating;

FIG. 27 is a diagram illustrating two diffusers of an embodiment of the invention providing task-ambient conditioning to an office space;

FIG. 28 is a diagram illustrating two diffusers of an embodiment of the invention providing task-ambient conditioning to an office space;

FIG. 29 is a diagram illustrating airflow rates, discharge patterns and discharge direction achieved when rotating the discharge element in a variation of the embodiment shown in FIG. 5;

FIG. 30 illustrates airflow patterns, direction and rate of an embodiment when configured for a vertical swirl pattern;

FIG. 31 illustrates airflow patterns, direction and rate of an embodiment when configured for directional-vertical pattern adjustment;

FIG. 32 is a diagram illustrating the discharge element and mounting ring of an embodiment of the invention offering directional swirl with an inclined axis and vertically directed axial swirl patterns;

FIG. 33 is a diagram illustrating the mounting ring, dirt collecting basket, swirl damper and directional damper orientation of the embodiment shown in FIG. 32 configured for a directional swirl pattern with inclined axis;

FIG. 34 illustrates airflow rate, direction and patterns of the embodiment shown in FIG. 32 configured for a directional swirl pattern with inclined axis;

FIG. 35 illustrates airflow rate, direction and pattern of the embodiment shown in FIG. 32 configured for a directional swirl pattern with inclined axis;

FIG. 36 illustrates airflow rate, direction and patterns of the embodiment shown in FIG. 32 configured for a vertically directed axial swirl pattern; and FIG. 37 illustrates airflow rate, direction and patterns of the embodiment shown in FIG. 32 when configured for directional-vertical pattern adjustment and when configured for electric actuator airflow rate adjustment with manual directional-vertical pattern adjustment.

DETAILED DESCRIPTION OF THE PREFERRED EMBODIMENT

By way of introducing embodiments of the present invention, aspects relating to diffusers are firstly mentioned. In underfloor air delivery systems, these systems are particularly well suited to providing "task-ambient" conditioning, in which individually adjustable floor diffusers at each workstation provide personalised "task" conditioning, whilst thermal comfort in "ambient" spaces, such as transient spaces or where prolonged occupancy does not occur, is less strictly controlled, thereby saving energy.

Underfloor air delivery systems in high heat load spaces, such as in call centres or perimeter zones of commercial offices, may distribute high volumes of supply air through high induction floor swirl diffusers placed in the access floor. Highly inductive upward discharge patterns are used to allow relatively large supply airflow rates to be achieved without creating draughts, as high induction of secondary room air into the supply air stream largely equalises the lower supply air temperature with room air temperature by intense dilution with occupancy zone air, and simultaneously brings about rapid discharge velocity decay. At the diffuser optimum design airflow rate, the resultant low velocity, high mass flow rate air stream projects upwards due to its high momentum, creating mixing to approximately head height of seated users and minimising the vertical temperature gradient in the occupancy zone to prevent the sensation of cold feet/warm head, even at high heat loads. The low velocity supply air stream does not penetrate or disturb the stratified layer of heat and contaminants above the occupancy zone, nor the plumes of heat rising from heat sources, so that the temperature differential between the low level supply air and the high level stratified layer of air is maximised, to in turn maximise heat and contaminant removal.

If the floor swirl diffuser airflow rate is increased substantially, however, increasing its vertical throw, then the stratified layer may be disturbed such that its heat and contaminants are mixed back into the occupancy zone, thereby reducing occupancy zone air quality and diminishing heat removal from the space; or if it is decreased substantially, then the mixing height may be reduced to the point that an excessive vertical temperature gradient forms in the occupancy zone, causing the sensation of cold feet/warm head. In this regard, halving the airflow rate halves the throw. Ideally, in such high heat load applications, the optimum vertical throw of the floor swirl diffuser should not be affected by occupant adjustability, i.e. mixing of air to approximately head height of seated users should not be disrupted by occupant adjustability of floor swirl diffuser airflow rate or direction. Upward discharge floor swirl diffusers of the prior art that offer airflow rate adjustability do not maintain such vertical throw to a largely constant height. As a result, they limit the available range of comfort adjustability. Their performance is usually further diminished by mechanical constraints applied to the airflow rate adjustability in a bid to minimise the risk of indoor air quality and thermostatic control from being compromised by users throttling airflow rate too greatly.

The degree of personalised "task" comfort control offered by known floor swirl diffusers with adjustable airflow rate is hence severely limited; indeed, such floor swirl diffusers are often the very cause of discomfort in the space. To overcome some of these shortcomings, floor swirl diffusers offering directional adjustment whilst maintaining throw to a constant height may be used as an alternative, but such diffusers, too, offer only limited thermal comfort control to users as they do not additionally provide occupant airflow rate adjustability.

In low heat load spaces, such as centre zones in highly energy efficient commercial offices, or in low occupancy spaces such as libraries, floor displacement diffusers with horizontally directed radial displacement type discharge patterns are typically placed in the access floor to provide low cooling capacities at low airflow rates that spread the supply air across the floor, effectively creating an ankle high "lake" of cool air over large floor areas providing "ambient" comfort that is usually not strictly controlled, especially in transient spaces where temperature control parameters may be more relaxed. Even though these diffusers do not create mixing to head height of seated users, the sensation of cold feet/warm head is prevented by the low vertical temperature gradient produced by the low heat loads.

Where heat loads are somewhat higher, such as in centre zones or transient spaces of commercial offices with medium heat loads, floor swirl diffusers with vertically upward swirl discharge are often used to provide "ambient" conditioning to the immediate vicinity whilst preventing the sensation of cold feet/warm head.

Where such horizontally directed displacement type diffusers with a radial discharge pattern or such swirl diffusers with a vertically upward swirl discharge pattern are used in transient spaces or in spaces without prolonged occupancy, diffuser airflow rate adjustability alone (albeit of limited range to prevent indoor air quality and thermostatic control from being compromised) is considered sufficient to fine-tune the localised thermal environment created by each diffuser. However, in areas with prolonged occupancy, such as near desks, there may be a need to extend the degree of comfort control provided by each of these two diffusers.

General Overview

The embodiment, as described herein, relates generally to an air diffuser assembly for placement in a floor opening in a raised access flooring system with an air distribution plenum beneath the access floor. The assembly comprises a mounting ring to be secured in the floor penetration. One of two removable circular discharge elements may be located in the mounting ring. Each discharge element, which may be manually rotated by users, comprises a central circular portion that discharges an air jet with an inclined axis diagonally upwards in generally one direction, surrounded by an annular discharge portion that discharges a swirl pattern of air biased to a horizontal radial discharge pattern in the first discharge element, and to a vertical axial pattern in the second discharge element. A dirt collecting basket with two chambers is located in the mounting ring beneath the selected discharge element. One chamber is circular and centrally located directly beneath the directionally inclined jet discharge portion of the discharge element, and is surrounded by the other chamber, which is annular and is directly located beneath the swirl discharge portion of the discharge element. Each chamber is fitted with a rotational damper mechanism that may be mechanically linked to the discharge element, thereby causing the linked damper to open and close through the arc of initial rotation of the discharge element. Damper limiting stops located on the dirt collecting basket cause further discharge element rotation in the same direction to rotate the entire discharge element, damper and dirt collecting basket assembly, preventing further manual airflow adjustment; instead, further rotation in the same direction adjusts discharge direction whenever a directional discharge pattern with inclined axis is in operation. Depending on which damper has been mechanically linked to the discharge element, manual adjustability of airflow rate, pattern and direction is realised by any one of the following three standard configurations for the first discharge element:

- a radially directed swirl airflow pattern when adjusted by the occupant to a low airflow rate, changing to a directional swirl pattern with inclined axis that can then be rotated towards or away from the occupant when adjusted to a high airflow rate; or
- a radially directed swirl airflow pattern that can be adjusted by the occupant to a low or a high airflow rate or that can be set to a fixed airflow rate, or
- regardless of the airflow rate setting or its adjustment by the occupant, a largely constant height directional swirl pattern with inclined axis that can be rotated towards or away from the occupant.

In an embodiment, a second discharge element may be realised by any one of the following three standard configurations:

- a vertically directed swirl airflow pattern when adjusted by the occupant to a low airflow rate, changing to a directional swirl pattern with inclined axis that can then be rotated towards or away from the occupant when adjusted to a high airflow rate; or
- a vertically directed swirl airflow pattern that can be adjusted by the occupant to a low or a high airflow rate or that can be set to a fixed airflow rate, or
- regardless of the airflow rate setting or its adjustment by the occupant, a largely constant height directional swirl pattern with inclined axis that can be rotated towards or away from the occupant.

On site reconfiguration to any one of the above standard configurations associated with the installed discharge element type, as the case may be, is possible using only the standard components comprising that diffuser, simply by opening the diffuser, without the need to remove the diffuser assembly from the floor penetration.

With each of the two discharge elements, the diffuser also allows simple retrofitting of an electrical actuator mechanism to achieve a specialised configuration to provide secondary thermostatic control (e.g. in meeting rooms) by electrically adjusting diffuser airflow rate in response to a signal received from a zone thermostat. In this configuration, marginal manual airflow rate adjustment is additionally possible by the occupant.

Moreover, as the airflow rate is manually increased, the diffuser airflow pattern adjusts from radially directed swirl to directional swirl with inclined axis with the first discharge element, or from vertically directed swirl to directional swirl with inclined axis with the second discharge element, that in each case can then be rotated towards or away from the occupant.

For each of the two discharge elements, a second specialised configuration of the diffuser comprises retrofitting a special damper that reduces the diffuser airflow rate to a range and throw suitable for air supply from beneath auditorium seats, without creating additional noise. Five airflow rate options can be set by opening the diffuser without removing it from the floor penetration. Once installed, the diffuser discharge pattern, configured to directional discharge with inclined axis, is directed towards the seat rear to minimise the threat of draughts in the leg region of the seated occupant.

Indicators visible from the room show actual and available diffuser airflow rate, discharge pattern and discharge direction (where applicable) for the given configuration, as well as indicating which configuration has been assembled.

Embodiments Described in the Figures

Reference numerals in the following description represent like components or features in the related figures.

Figure 1:
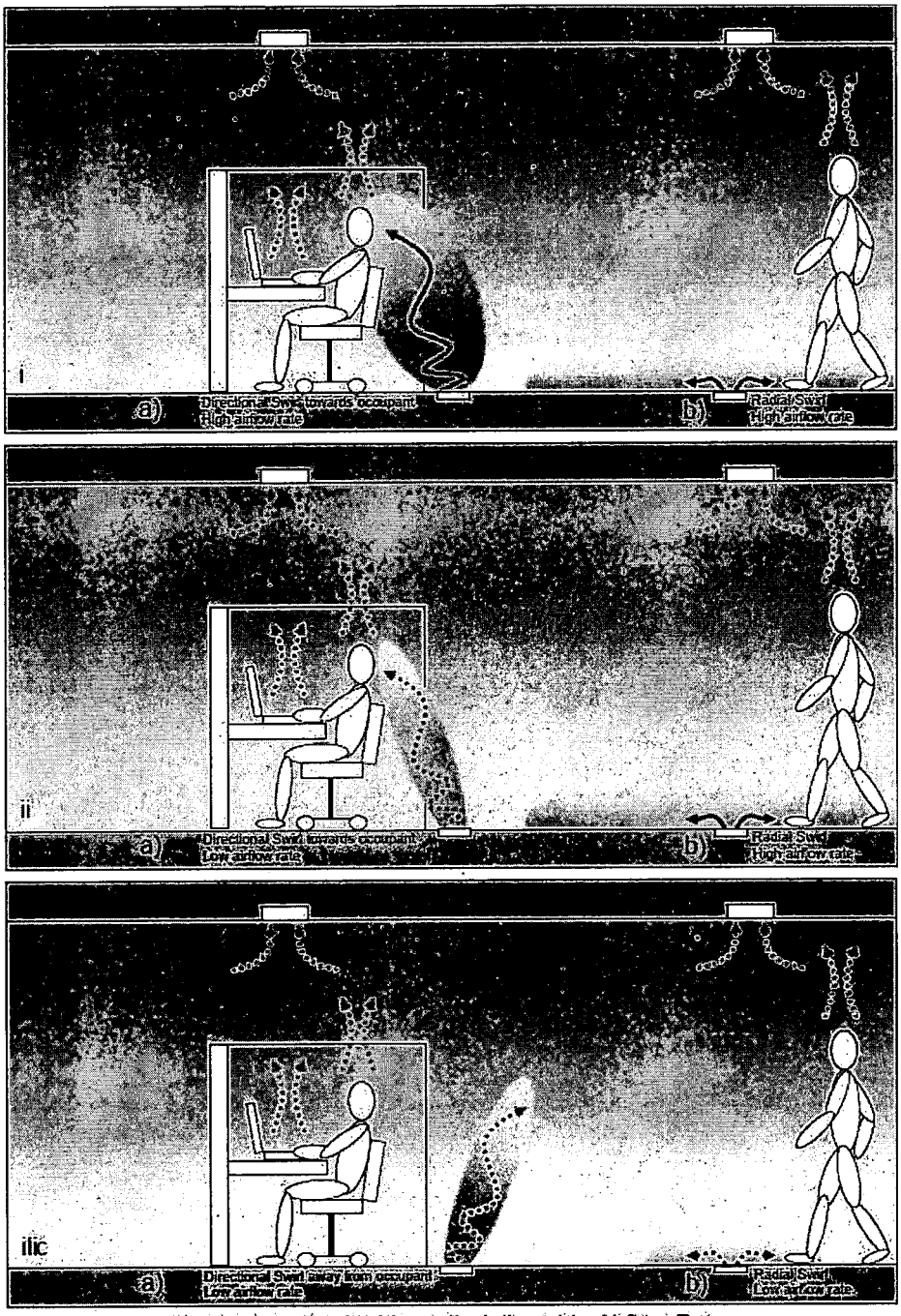
FIG. 1 is a diagram illustrating two diffusers of an embodiment of the invention providing task-ambient conditioning to an office space.

FIG. 1 shows task-ambient conditioning of an office space in which two diffusers as described by embodiments of the invention are depicted, each with a discharge element with swirl slots that produce swirl discharge with a radial bias, and with manually adjustable airflow rate: a) configured to a directional swirl pattern with inclined axis that additionally provides manual discharge direction adjustment by rotation; b) configured to a radial swirl pattern:

i) a) shows the directional swirl pattern with inclined axis manually adjusted to a high airflow rate and rotated towards the seated occupant.
   b) shows the radial swirl pattern manually adjusted to a high airflow rate.

ii) a) shows the directional swirl pattern with inclined axis manually adjusted to a low airflow rate and rotated towards the seated occupant.
   b) shows the radial swirl pattern manually adjusted to a high airflow rate.

iii) a) shows the directional swirl pattern with inclined axis manually adjusted to a low airflow rate and rotated away from the seated occupant.
   b) shows the radial swirl pattern manually adjusted to a low airflow rate.

Figure 2:
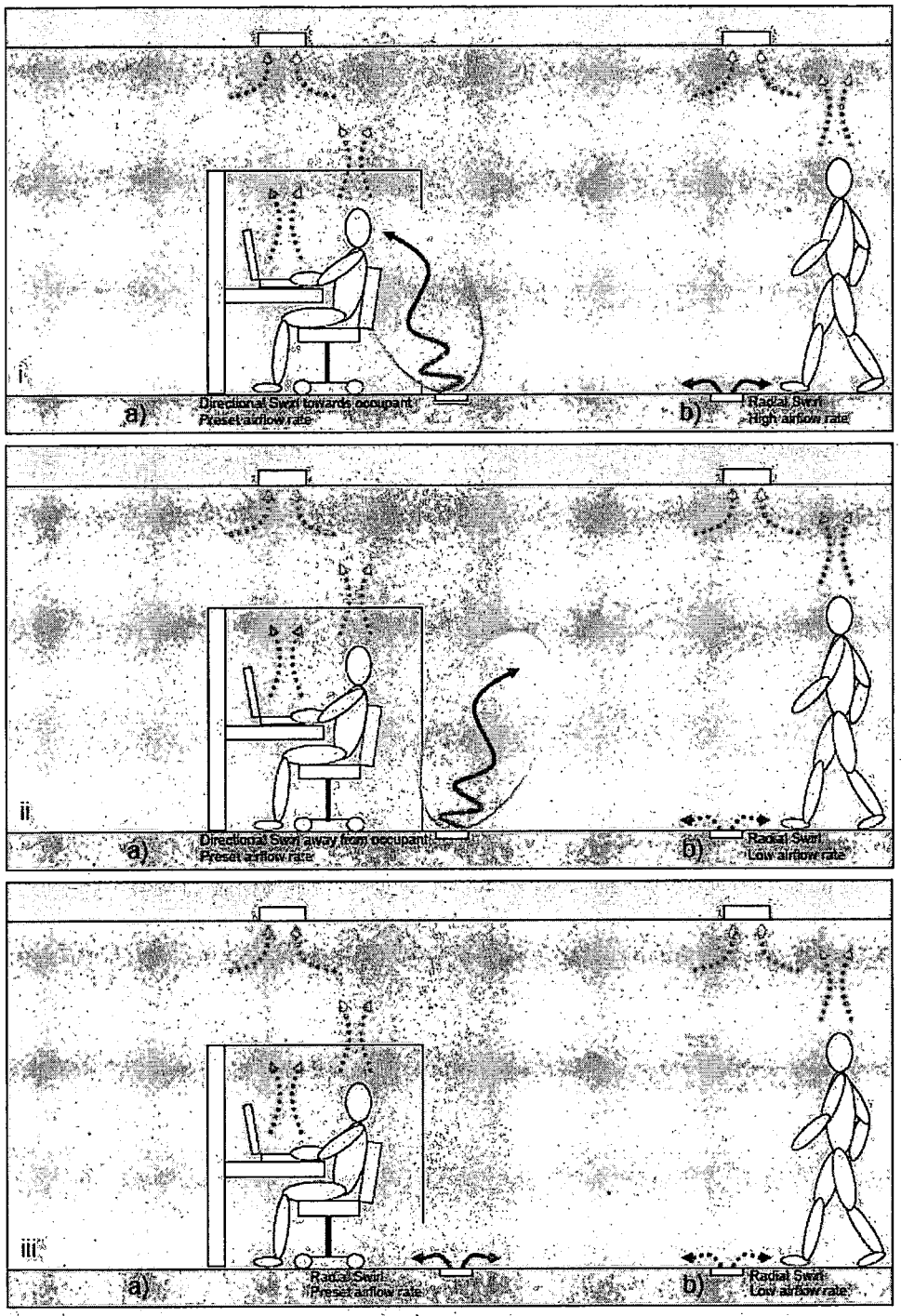
FIG. 2 is a diagram illustrating two diffusers of an embodiment of the invention providing task-ambient conditioning to an office space.

FIG. 2 shows task-ambient conditioning of an office space in which two diffusers as described by embodiments of the invention are depicted, each with a discharge element with slots that produce swirl discharge with a radial bias: a) with preset or electrically adjustable airflow rate providing a directional swirl pattern with inclined axis that may be manually rotated to change discharge direction and that may additionally be manually adjusted to a radial swirl pattern; b) configured for a radial swirl pattern with manually adjustable airflow rate:

i) a) shows the directional swirl pattern with inclined axis and with preset or electrically adjusted airflow rate (depicted high) directed towards the seated occupant.

b) shows the radial swirl pattern adjusted to a high airflow rate.

ii) a) shows the directional swirl pattern with inclined axis and with preset or electrically adjusted airflow rate (depicted high) directed away from the seated occupant.

b) shows the radial swirl pattern adjusted to a low airflow rate.

iii) a) shows the diffuser with preset or electrically adjusted airflow rate (depicted high) adjusted to a radial swirl pattern.

b) shows the radial swirl pattern adjusted to a low airflow rate.

FIG. 3 shows an auditorium application of floor swirl air distribution, in which:

i) a) shows the prior art with symmetrical upward swirl discharge of a fixed airflow rate, and b) shows the diffuser described by an embodiment of the invention with a directional swirl discharge pattern directed towards the rear of the seat to reduce the draught threat in the leg region of the seated occupant.

ii) a)-d) show the preferred embodiment set to a low airflow rate in the front row (or rows in a large auditorium) ranging to the highest airflow rate in the rear two rows (or more in a large auditorium) to compensate for the increased local room temperature that occurs as seat height is raised.

Figure 4:
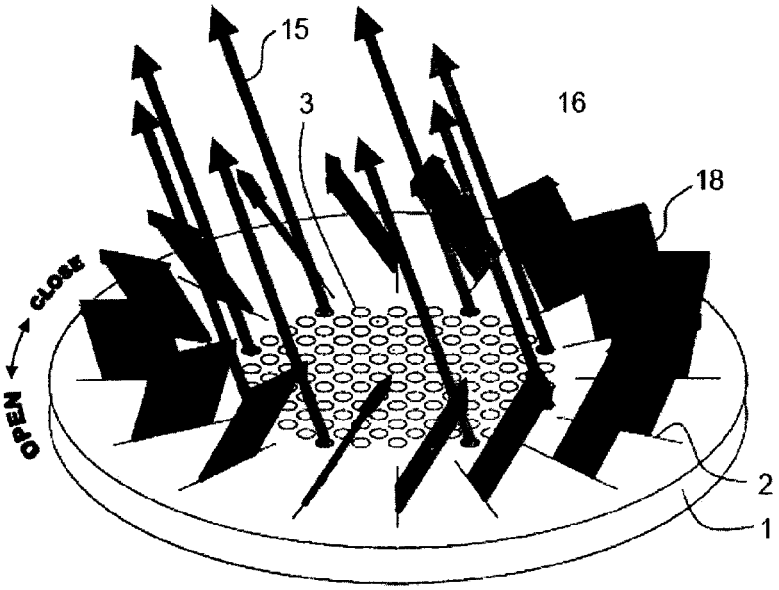
FIG. 4 is a diagram illustrating a perspective view of the floor swirl diffuser discharge element in accordance with the invention.

FIG. 4 shows the floor swirl diffuser comprising a round discharge element (1) with largely radial swirl slots (2) that discharge air with swirl (18), which may be biased to direct the swirl pattern radially or vertically, and directional holes (3) that discharge air in a directional jet with inclined axis (15). Not shown, for the sake of simplicity, are further embodiments with differently shaped openings, such as directional discharge openings (3) shaped as slots.

FIG. 5 shows a floor swirl diffuser unit consisting of the floor swirl diffuser element (1) shown in FIG. 4 resting in mounting ring (4), in which the floor swirl diffuser element (1) is able to rotate through 360°. The mounting ring (4) is shown inserted in floor penetration (5). Also resting in the mounting ring is dirt collecting basket (6) housing swirl damper (7) in annular chamber (8) and directional airflow damper (9) in central chamber (10). Swirl damper (7) is able to rotate within basket (6), which is able to rotate within mounting ring (4). Directional damper (9) is also able to rotate within basket (6), and is locked by at least one pin (11) or by some other mechanical means to rotate when discharge element (1) is rotated. Directional damper (9) is able to rotate freely within central chamber (10) in either direction until it hits limiting stop (12). When directional damper (9) is open, air flow (13) from floor plenum (14) passes into central chamber (10) to be discharged (15) by directional openings (3) into occupancy space (16). When swirl damper (7) is open, air flow (17) from floor plenum (14) passes into annular chamber (8) to be discharged as swirl airflow (18) by swirl slots (2) into occupancy space (16).

Figure 6:
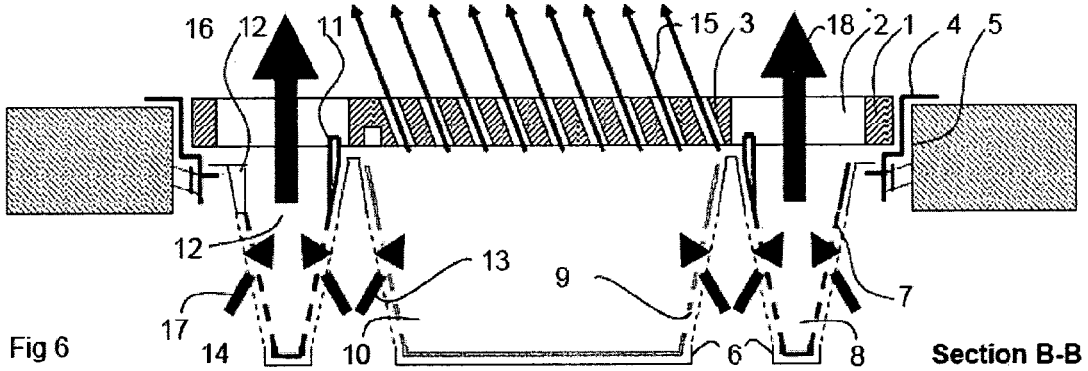
FIG. 6 is a diagram illustrating another embodiment of the floor swirl diffuser section according to the invention.

FIG. 6 is another embodiment of the swirl diffuser section shown in FIG. 5, in which swirl damper (7), rather than directional damper (9), is mechanically locked to discharge element (1) by pin (11) and limiting stop (12) limits the rotation of swirl damper (7) rather than that of directional damper (9).

FIG. 7 shows airflow rate, pattern and direction schematics relating to FIG. 5, incorporating a discharge element (1) with a radial bias to the swirl discharge pattern. Swirl damper (7), manually adjustable by removing discharge element (1), is shown set fully open creating swirl discharge (18) in both diagrams a) and b). Directional damper (9), adjustable by rotating discharge element (1), is shown fully open in diagram a) and closed in diagram b). Swirl discharge (18) in diagram b) spreads across the floor from the diffuser as horizontally directed displacement type radial swirl discharge (20) into the occupancy space (16). Counter-clockwise rotation of discharge element (1) in diagram b) rotates directional damper (9) from the closed to the open position, as in diagram a), creating directional discharge with inclined axis (15) that induces the surrounding swirl discharge (18) upwards to form a directional swirl discharge pattern with inclined axis (19) into the occupancy space (16). Further counter-clockwise rotation pushes directional damper (9) against limiting stop (12) rotating the directional swirl discharge direction (19) counter-clockwise about the diffuser central axis without altering airflow rate or pattern. Clockwise rotation of swirl element (1) from a) to b) shuts directional damper (9), preventing directional discharge in diagram b). In the absence of upward and inward induction from the directional discharge jet (15), swirl discharge (18) spreads across the floor creating a horizontally directed displacement type radial swirl discharge pattern (20). Not shown, for the sake of simplicity, is leakage from directional damper (9) when in the fully closed position, that assists in preventing a detrimental negative pressure region from forming in the hub of discharge element (1) that may destabilise the horizontally directed displacement type radial swirl airflow pattern. FIG. 9 summarises airflow rate, pattern and direction options relating to FIG. 7.

FIG. 8 shows airflow rate, pattern and direction schematics relating to FIG. 6 and is valid for a discharge element (1) that has either a radial or a vertical swirl bias from swirl slots (2). For the sake of simplicity directional damper (9) and associated dirt collecting basket components are not shown. Assume directional damper (9), manually adjustable by removing discharge element (1), has been set fully open. Swirl damper (7), adjustable by rotating discharge element (1), is shown fully open in both diagrams c) and d) creating swirl discharge (18), and closed in diagrams e) and f) resulting in no swirl discharge. Directional discharge (15) in diagrams c) and d) induces swirl discharge (18) diagonally upwards to provide a directional swirl discharge pattern with inclined axis (19) into the occupancy space (16). In diagrams e) and f) directional discharge (15) discharges diagonally upwards on its own producing a directional jet discharge pattern with an inclined axis (21) of reduced airflow rate in comparison to directional swirl pattern (19) but with throw to a similar height. Counter-clockwise rotation of discharge element (1) in diagram e) rotates swirl damper (7) from closed to open, as in diagram a), creating swirl discharge (18) that is induced upwards by directional discharge (15) resulting in a directional swirl discharge pattern with inclined axis (19). Further counter-clockwise rotation, such as from c) to d), pushes swirl damper (7) against limiting stop (12) rotating directional swirl discharge pattern (19) counter-clockwise about the central axis without altering airflow rate or pattern. Clockwise rotation of swirl element (1), such as from c) to e), shuts swirl damper (7), preventing swirl discharge in diagram e), resulting in a directional jet discharge pattern with inclined axis (21) of reduced airflow rate in comparison to directional swirl pattern with inclined axis (19) but with throw to a similar height. Further clockwise rotation of discharge element (1), such as from e) to f), rotates the directional jet discharge direction (21) clockwise about the central axis without further altering airflow rate or pattern. FIG. 10 summarises airflow rate, pattern and direction options.

Not shown, for the sake of simplicity, is the case in which directional damper (9) in FIG. 6 is closed, whereby counter-clockwise rotation of a discharge element (1) equipped with swirl slots (3) that provide a radial swirl bias opens swirl damper (8) producing a horizontally directed displacement type radial swirl pattern (20), whereas clockwise rotation shuts off the horizontally directed displacement type radial swirl airflow. FIG. 11 summarises associated airflow rate, pattern and direction options.

Not shown, for the sake of simplicity, is the case where both the directional damper and the swirl damper are mechanically linked to the discharge element (equipped with swirl slots that produce an air pattern with either a radial swirl bias or a vertical swirl bias) so that the degree of discharge element rotation determines the percentage opening of both dampers simultaneously: when set to fully open, both dampers are fully open; when set to fully closed, both dampers are fully closed; similarly, for partially open settings the percentage of partial opening applies to both dampers. This configuration, in which both damper positions are operated simultaneously and hence airflow rate is most strongly affected by damper position, directs the combined supply air stream directionally at an inclined axis and is the most suitable configuration for the variety of reduced airflow rates typically required at low noise levels from air supply beneath auditorium seats. This is so, as this configuration minimises the likelihood of extremely small damper aperture settings that typically cause noise and that would more likely be required of one damper if the other were fully open. Moreover, as the air is discharged through all of the diffuser discharge openings, air velocities in the diffuser discharge slots are minimised, further reducing noise. Additionally, this configuration allows high induction swirl discharge to equalise the temperature and break down the velocity of the supply air stream, reducing the threat of draughts, while utilising directional discharge with an inclined axis to direct the combined air stream away from the draught sensitive leg region of the seated occupant, further enhancing comfort.

Figure 12:
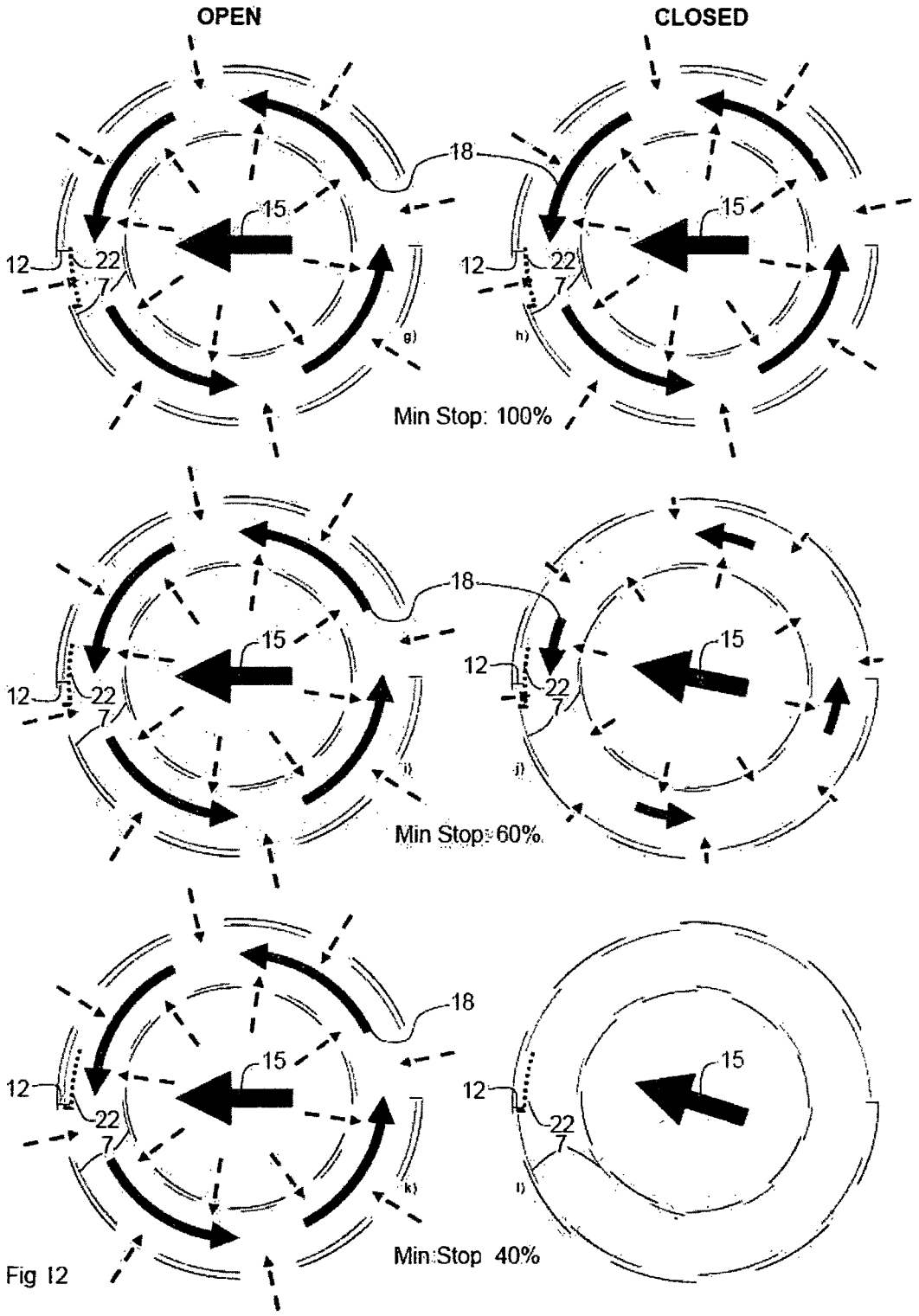
FIG. 12 is a diagram illustrating adjustable minimum airflow rate stops that can be used in combination with the embodiment shown in FIG. 6.

FIG. 12 shows adjustable minimum limiting stop (22) attached to limiting stop (12) for the embodiment shown in FIG. 6, to preset the minimum permissible airflow rate from the diffuser. Minimum airflow percentages shown are based on directional discharge (15) preset fully open to account for approximately 40% of total airflow. Swirl damper (7) is locked in the fully open position when minimum limiting stop (22) is set to 100%, as shown in diagrams g) and h), so that any rotation of discharge element (1) will cause the directional swirl discharge pattern (19) to rotate, as described in FIG. 8, without adjusting airflow rate. At smaller settings, such as 60%, as shown in diagrams i) and j), swirl damper (7) is able to close slightly as it rotates clockwise through a small arc before hitting adjustable minimum limiting stop (22), thereby reducing total diffuser airflow rate to 60%. Clockwise rotation beyond j) and counter-clockwise rotation beyond i) will cause the directional swirl discharge pattern (19) to rotate, as described in FIG. 8, whilst the diffuser discharges 60% and 100% of total airflow, respectively. When adjustable minimum limiting stop (22) is set fully closed, corresponding to the 40% setting as shown in diagrams k) and l), swirl damper (7) is able to close fully as it rotates clockwise before hitting adjustable minimum limiting stop (22), thereby reducing total diffuser airflow rate to 40%. Clockwise rotation beyond k) and counter-clockwise rotation beyond l) will cause the directional swirl discharge pattern (19) to rotate, as described in FIG. 8, whilst the diffuser discharges 40% and 100% of total airflow, respectively.

If adjustable minimum limiting stop (22) is attached to limiting stop (12) shown in FIG. 5, rather than to that shown in FIG. 6, then it can be used to preset the minimum permissible airflow rate for the embodiment shown in FIG. 5. This is not shown for the sake of simplicity. Similarly, adjustable maximum limiting stops can be used in both embodiments, to preset the maximum permissible airflow rate from the diffuser. These are again not shown, for the sake of simplicity.

Figure 13:
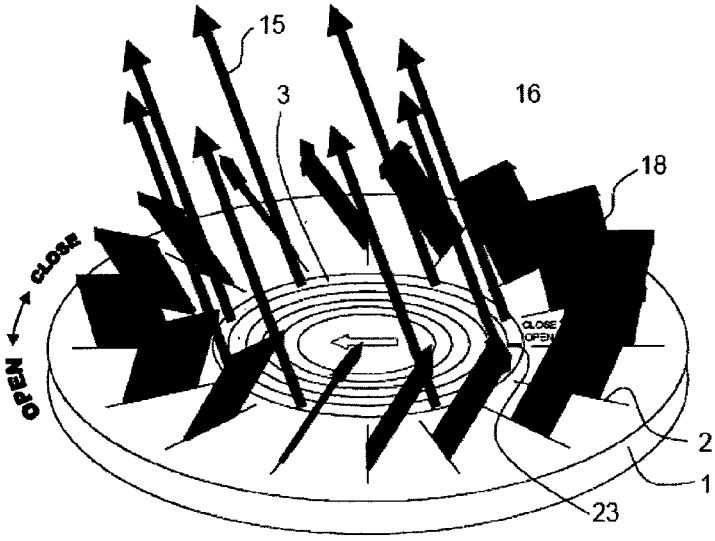
FIG. 13 is a diagram illustrating another embodiment of the circular discharge element according to the invention.
Figure 14:
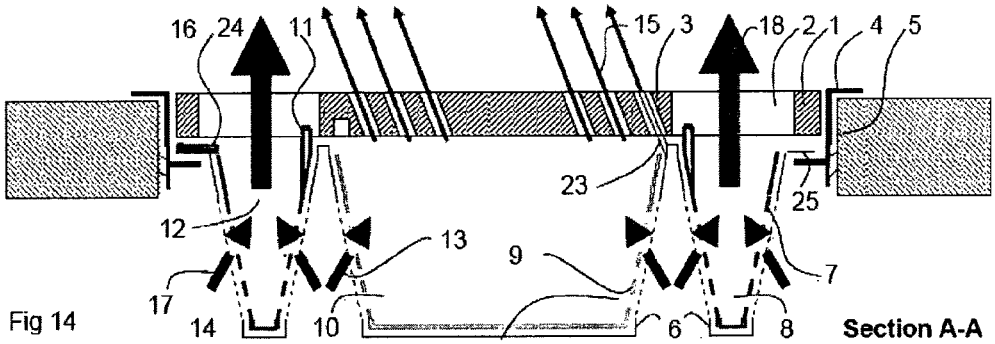
FIG. 14 is a diagram illustrating another embodiment of the floor swirl diffuser section according to the invention.

FIG. 13 shows an embodiment of discharge element (1) shown in FIG. 4 in which the directional perforated openings have been replaced with directional concentric slots (3). Open-closed indicator (23), described in FIG. 14, is located in one of the directional concentric slots (3) adjacent to open-closed markings on discharge element (1). Not shown, for the sake of simplicity, are further embodiments in which the largely radial swirl slots (2), or alternatively swirl vanes, are located beneath largely concentric discharge openings on the visible surface of discharge element (1).

FIG. 14 shows an embodiment of the swirl diffuser section shown in FIG. 6, with discharge element (1) shown in FIG. 13, in which open-closed indicator (23) protrudes from dirt collecting basket (6) into a directional concentric slot (3) adjacent to open-closed markings on discharge element (1) to be visible from within the occupancy space (16), as shown in FIG. 13. Rotation of discharge element (1) relative to dirt collecting basket (6) causes the open-closed markings on discharge element (1) to rotate relative to open-closed indicator (23) to provide evidence of swirl damper (7) position. Not shown, for the sake of simplicity, is an embodiment of the swirl diffuser section shown in FIG. 6 with open-closed indicator (23) attached to directional damper (9) rather than to dirt collecting basket (6) so that the open-closed indicator also indicates the preset open/closed position of directional damper (9). Also not shown, for the sake of simplicity, is an embodiment of the swirl diffuser section shown in FIG. 5 with open-closed indicator (23) protruding from dirt collecting basket (6), as described above, to provide evidence only of directional damper (9) position.

Figure 15:
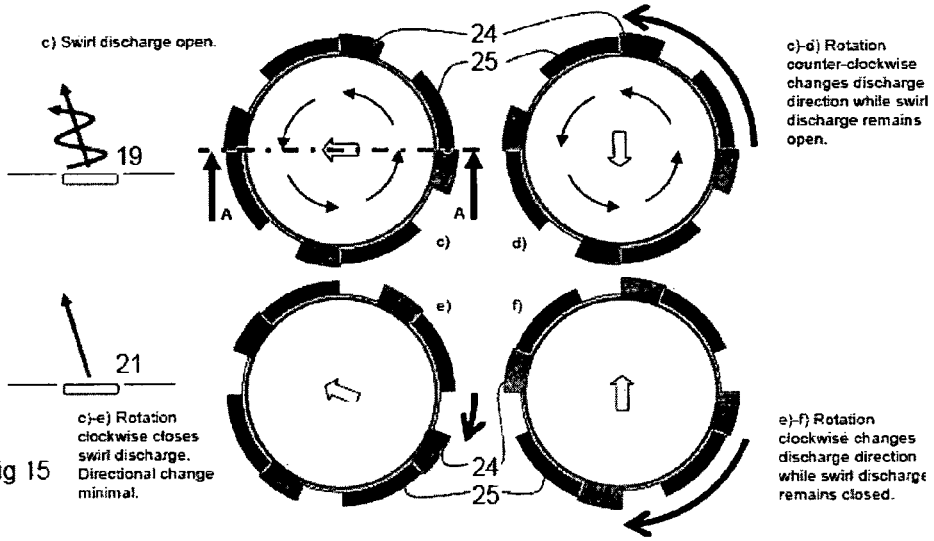
FIG. 15 is a diagram illustrating airflow rates, discharge patterns and discharge direction options achieved when rotating the discharge element in the embodiment shown in FIG. 14.

FIG. 14 shows a section from FIG. 15, which is a further embodiment of the diffuser section shown in FIG. 6, in which mounting ring (4) has a single step, and discharge element (1) rests on swirl damper lip (24), but not on the thinner dirt collecting basket lip (25), rather than resting on a second step in mounting ring (4).

FIG. 15 shows a plan view of the diffuser section shown in FIG. 14 and illustrates the discharged airflow rate, airflow pattern and airflow direction. Swirl damper lips (24) and dirt collecting basket lips (25) form concentric segments in which the dirt collecting basket lips (25) double up as limiting stops replacing the limiting stops (12) in FIG. 6. Adjustment of airflow rate, airflow pattern and airflow direction are in accordance with FIG. 10, as well as with FIG. 11 (for discharge element (1) with swirl slots (3) that produce an air pattern with radial swirl bias) and with FIG. 30 (for discharge element (1) with swirl slots (3) that produce an air pattern with vertical swirl bias) and are as per damper positions shown in FIG. 8. Not shown, for the sake of simplicity, is an embodiment of FIG. 15 providing adjustment of airflow rate, airflow pattern and airflow direction in accordance with FIGS. 9 and 31 (for discharge element (1) with swirl slots (3) that produce an air pattern with radial swirl bias) and as per damper positions and operation shown in FIGS. 7 and 29 (for discharge element (1) with swirl slots (3) that produce an air pattern with vertical swirl bias).

FIG. 16 shows the top and bottom views, as well as a section, of an embodiment of discharge element (1), as well as the top view of mounting ring (4). The discharge face of discharge element (1) comprises radial swirl slots (2) that may be largely helical in section to discharge air in a swirling pattern with radial bias, and concentric slots (3) that discharge air in a directional jet of inclined axis. Symbols on the face, when read in conjunction with indicators (23 *a*) to (23 *d*)—not shown in FIG. 16 but described in the following paragraphs and shown in FIG. 17 onwards—provide evidence of diffuser configuration, discharge pattern, discharge direction, and airflow rate. The underside of discharge element (1) is equipped with six protruding feet (26) and one concentrically elongated protruding foot (27), as well as three outer dimples (29) and one outer concentric depression (30), as well as one inner dimple (31) and two inner concentric depressions (32). Not shown, for the sake of simplicity, is an embodiment with a spring lock, or similar, that locks discharge element (1) into mounting ring (4) to prevent unauthorised removal of discharge element (1) by users.

Figure 17:
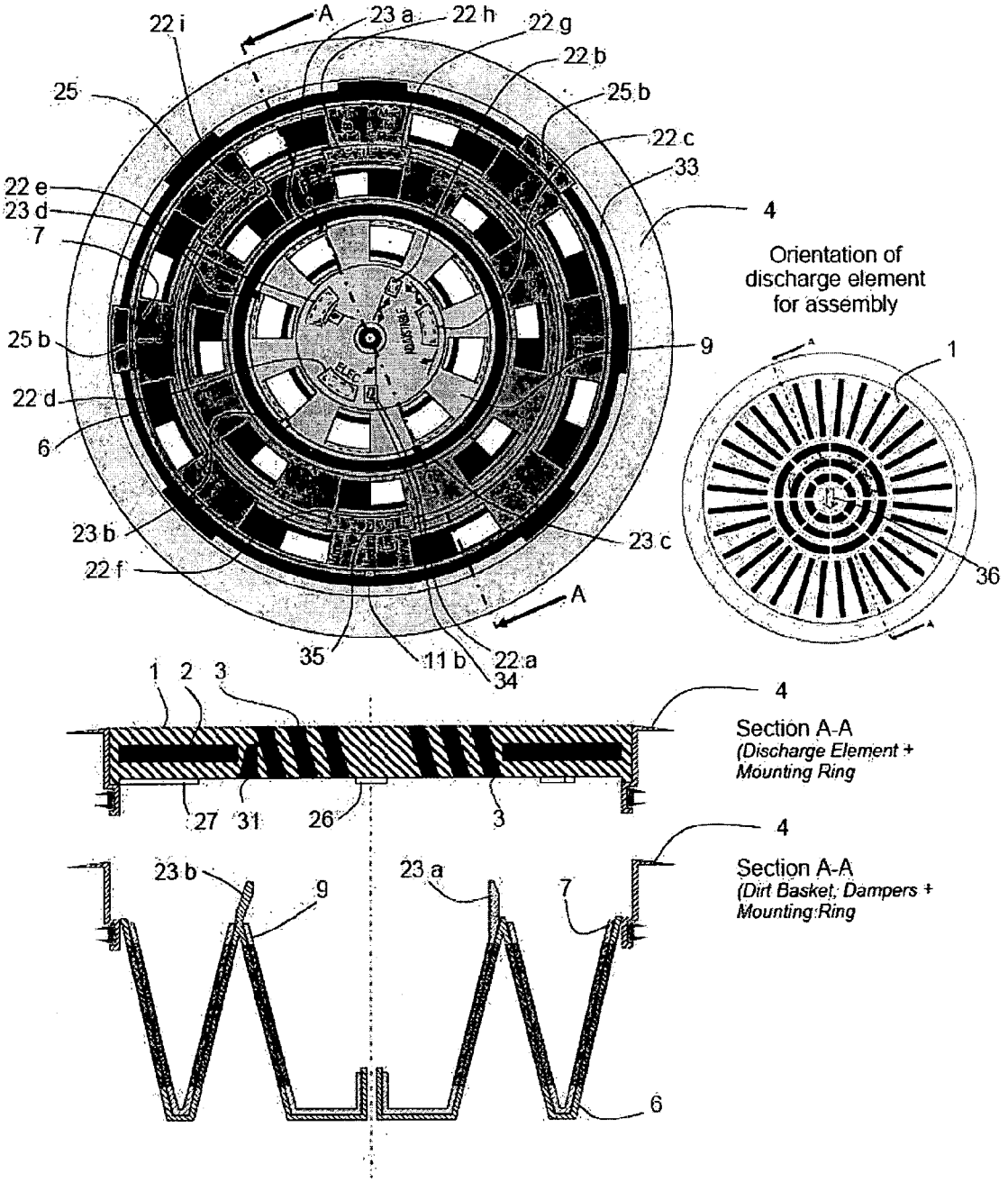
FIG. 17 is a diagram illustrating the mounting ring, dirt collecting basket, swirl damper and directional damper orientation of the embodiment shown in FIG. 16 configured for a directional swirl pattern with inclined axis.

FIG. 17 shows, for the embodiment shown in FIG. 16, the top view of the mounting ring with dirt collecting basket and dampers, as well as the associated side view, plus a side view of discharge element (1), and component orientation for diffuser assembly to realise a "directional swirl" configuration. The discharge element feet (26 & 27) rest on recessed edge (33) of mounting ring (4) raising the underside of discharge element (1) clear of the five dirt collecting basket lips (25*a*) and two dummy lips (25*b*), which also rest on recessed edge (33) of mounting ring (4). The two removable dummy lips (25*b*), shown at the nine o'clock and half past one positions in the plan view, clip onto dirt collecting basket (6) into any two of three possible locations (9 o'clock, 6 o'clock and half past one), with that location left blank that coincides with markings (not shown for the sake of simplicity) on the dirt collecting basket indicating the configuration that is being assembled. The 9 o'clock location will be marked "electrical", the 6 o'clock location "directional or radial" (for a discharge element (1) with swirl slots (3) that produce a swirl air pattern with radial bias) and "directional or vertical" (for a discharge element (1) with swirl slots (3) that produce a swirl air pattern with vertical bias) and the half past one location "directional-radial adjustment" and "directional-vertical". (In the case of FIG. 17 the configuration shown is "directional swirl", which corresponds with the 6 o'clock location.) Directional damper (9) is installed with "directional" dimple (22*a*) pressed onto nipple (34) (shown in FIG. 19). Indicators (23*c* & 23*d*) lock directional damper (9) into place so that its configuration setting cannot be inadvertently disturbed (e.g. by cleaners opening the diffuser). Swirl damper (7) is installed in one of eight orientations such that ridge (35) (shown in FIG. 19) slots into fixed airflow stop positions min, low, med (as shown), high, or max (22*f*), or into airflow range stops min-med (22*h*), med-max (22*g*), or into airflow range stop min-max (22*i*). The two dummy lips (25*b*) lock swirl damper (7) into place so that its configuration setting cannot be inadvertently disturbed (e.g. by cleaners opening the diffuser). Discharge element (1), orientated as shown with the directional arrow (36) directed towards the location with a missing dummy lip (6 o'clock in this instance), this being the only orientation in which elongated foot (27) will enable assembly for this configuration, is placed into mounting ring (4). Nipple (11*b*) notches into dimple (29), and indicators (23*b* & 23*c*) slot into concentric recesses (32) to be hidden from view whilst indicators (23*a* & 23*d*) protrudes into concentric slots (3) to be visible from within the room, as shown in FIG. 18.

FIG. 18 summarises discharge pattern, direction and airflow rates available in the "directional swirl" configuration shown in FIG. 17 and shows associated indicator (23*a* & 23*d*) location in each instance.

Figure 19:
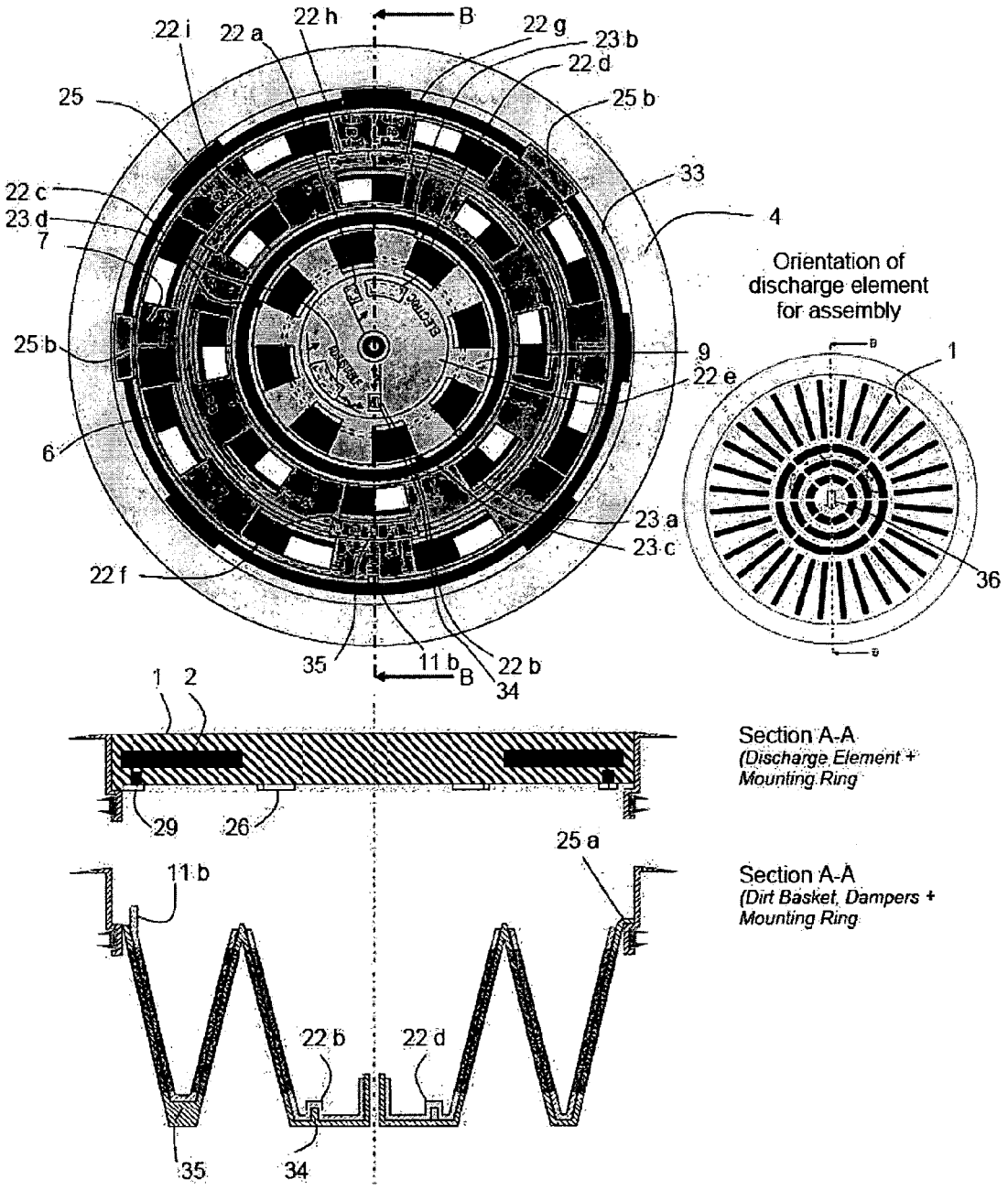
FIG. 19 is a diagram illustrating the mounting ring, dirt collecting basket, swirl damper and directional damper orientation of the embodiment shown in FIG. 16 configured for a horizontally directed displacement type radial swirl pattern.

FIG. 19 shows the top view of the mounting ring with dirt collecting basket and dampers, as well as the associated side view, plus a side view of discharge element (1) with swirl slots (3) that produce an air pattern with radial swirl bias, and component orientation for diffuser assembly to realise a "radial swirl" configuration. The discharge element feet (26 & 27) rest on recessed edge (33) of mounting ring (4) raising the underside of discharge element (1) clear of the five dirt collecting basket lips (25*a*) and two dummy lips (25*b*), which also rest on recessed edge (33) of mounting ring (4). The two removable dummy lips (25*b*), shown at the nine o'clock and half past one positions in the plan view, clip onto dirt collecting basket (6) into any two of three possible locations (9 o'clock, 6 o'clock and half past one), with that location left blank that coincides with markings (not shown for the sake of simplicity) on the dirt collecting basket indicating the configuration that is being assembled. The 9 o'clock location will be marked "electrical", the 6 o'clock location "directional or radial" and the half past one location "directional-radial adjustment" (in the case of FIG. 19 this configuration is "radial swirl", which corresponds with the 6 o'clock location). Directional damper (9) is installed with "radial" airflow slot (22*b*) pressed onto nipple (34). Indicators (23*c* & 23*d*) lock directional damper (9) into place so that its configuration setting cannot be inadvertently disturbed (e.g. by cleaners opening the diffuser). Swirl damper (7) is installed in one of eight orientations such that ridge (35) slots into fixed airflow stop positions min, low, med (as shown), high, or max (22*f*), or into airflow range stops min-med (22*h*) or med-max (22*g*), or into airflow range stop min-max (22*i*). The two dummy lips (25*b*) lock swirl damper (7) into place so that its configuration setting cannot be inadvertently disturbed (e.g. by cleaners opening the diffuser). Discharge element (1), orientated as shown with the directional arrow (36) directed towards the location with a missing dummy lip (6 o'clock in this instance), this being the only orientation in which elongated foot (27) will enable assembly for this configuration, is placed into mounting ring (4). Nipple (11*b*) notches into dimple (29), and indicators (23*a* & 23*c*) slot into concentric recesses (32) to be hidden from view whilst indicators (23*b* & 23*d*) protrudes into concentric slots (3) to be visible from within the room, as shown in FIG. 20.

FIG. 20 summarises discharge pattern, direction and airflow rates available in the "radial swirl" configuration shown in FIG. 19 and shows associated indicator (23*b* & 23*d*) location in each instance.

Figure 21:
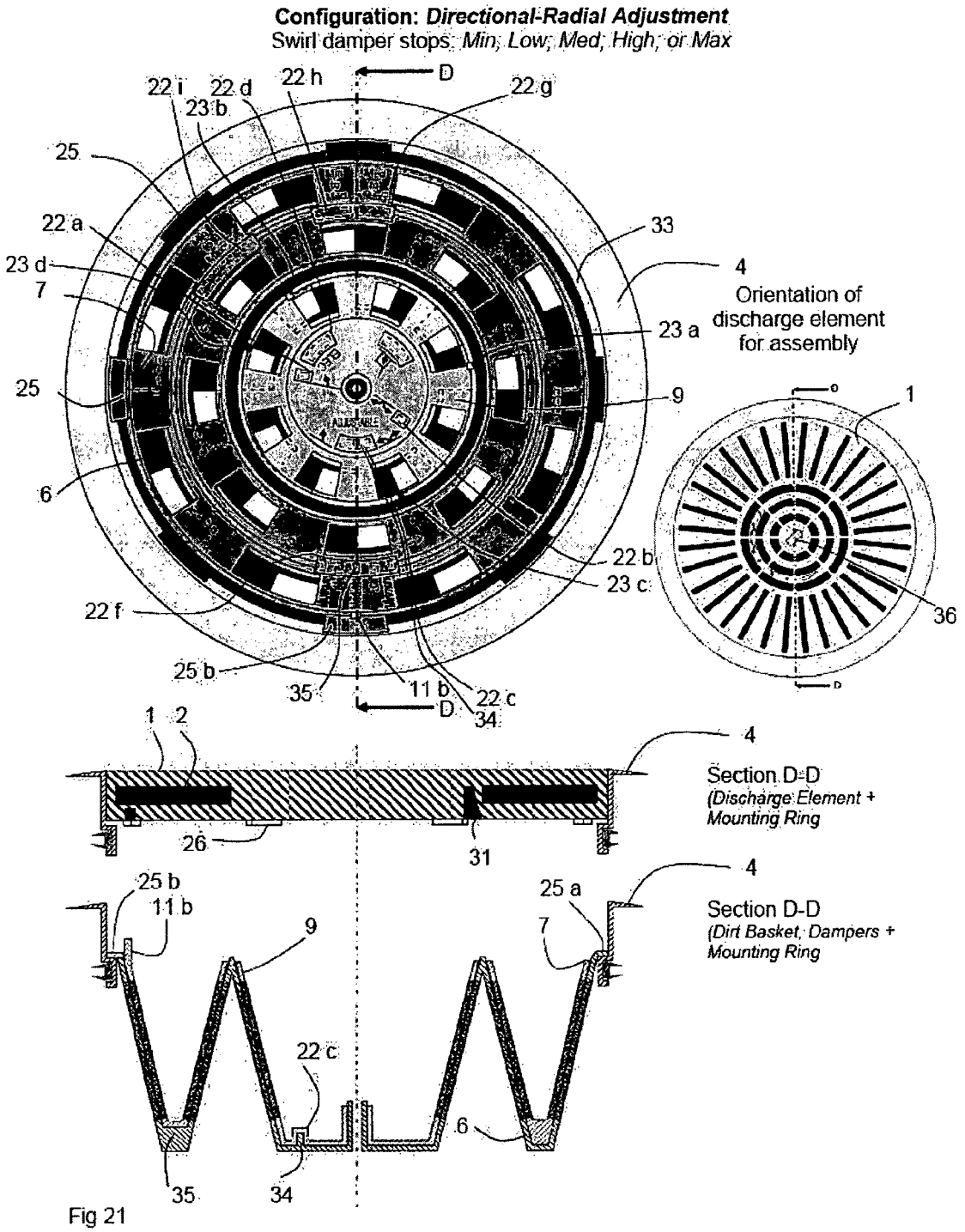
FIG. 21 is a diagram illustrating the mounting ring, dirt collecting basket, swirl damper and directional damper orientation of the embodiment shown in FIG. 16 configured for directional-radial pattern adjustment.

FIG. 21 shows the top view of the mounting ring with dirt collecting basket and dampers, as well as the associated side view, plus a side view of discharge element (1) with swirl slots (3) that produce an air pattern with radial swirl bias, and component orientation for diffuser assembly to realise a "directional-radial adjustment" configuration. The discharge element feet (26 & 27) rest on recessed edge (33) of mounting ring (4) raising the underside of discharge element (1) clear of the five dirt collecting basket lips (25*a*) and two dummy lips (25*b*), which also rest on recessed edge (33) of mounting ring (4). The two removable dummy lips (25*b*), shown at the 9 o'clock and 6 o'clock positions in the plan view, clip onto dirt collecting basket (6) into any two of three possible locations (9 o'clock, 6 o'clock and half past one), with that location left blank that coincides with markings (not shown for the sake of simplicity) on the dirt collecting basket indicating the configuration that is being assembled. The 9 o'clock location will be marked "electrical", the 6 o'clock location "directional or radial" and the half past one location "directional-radial adjustment" (in the case of FIG. 21 this configuration is "directional-radial adjustment", which corresponds with the half past one location). Directional damper (9) is installed with "directional-radial adjustment" slot (22*c*) over nipple (34). Indicators (23*c* & 23*d*) lock directional damper (9) into place so that its configuration setting cannot be inadvertently disturbed (e.g. by cleaners opening the diffuser). Swirl damper (7) is installed in one of five orientations such that ridge (35) slots into fixed airflow stop positions min, low, med (as shown), high, or max (22*f*). The two dummy lips (25*b*) lock swirl damper (7) into place so that its configuration setting cannot be inadvertently disturbed (e.g. by cleaners opening the diffuser). Discharge element (1), orientated as shown with the directional arrow (36) directed towards the location with a missing dummy lip (half past one in this instance), this being the only orientation in which elongated foot (27) will enable assembly for this configuration, is placed into mounting ring (4). Nipple 11*b* slots into concentric recess 30, and indicators (23*a* & 23*b*) notch into recess (32) and dimple (31) to be hidden from view whilst indicators (23*c* & 23*d*) protrude into concentric slots (3) to be visible from within the room, as shown in FIG. 22.

FIG. 22 summarises discharge pattern, direction and airflow rates available in the "directional-radial adjustment" configuration shown in FIG. 21 and shows associated indicator (23*c* & 23*d*) location in each instance.

Figure 23:
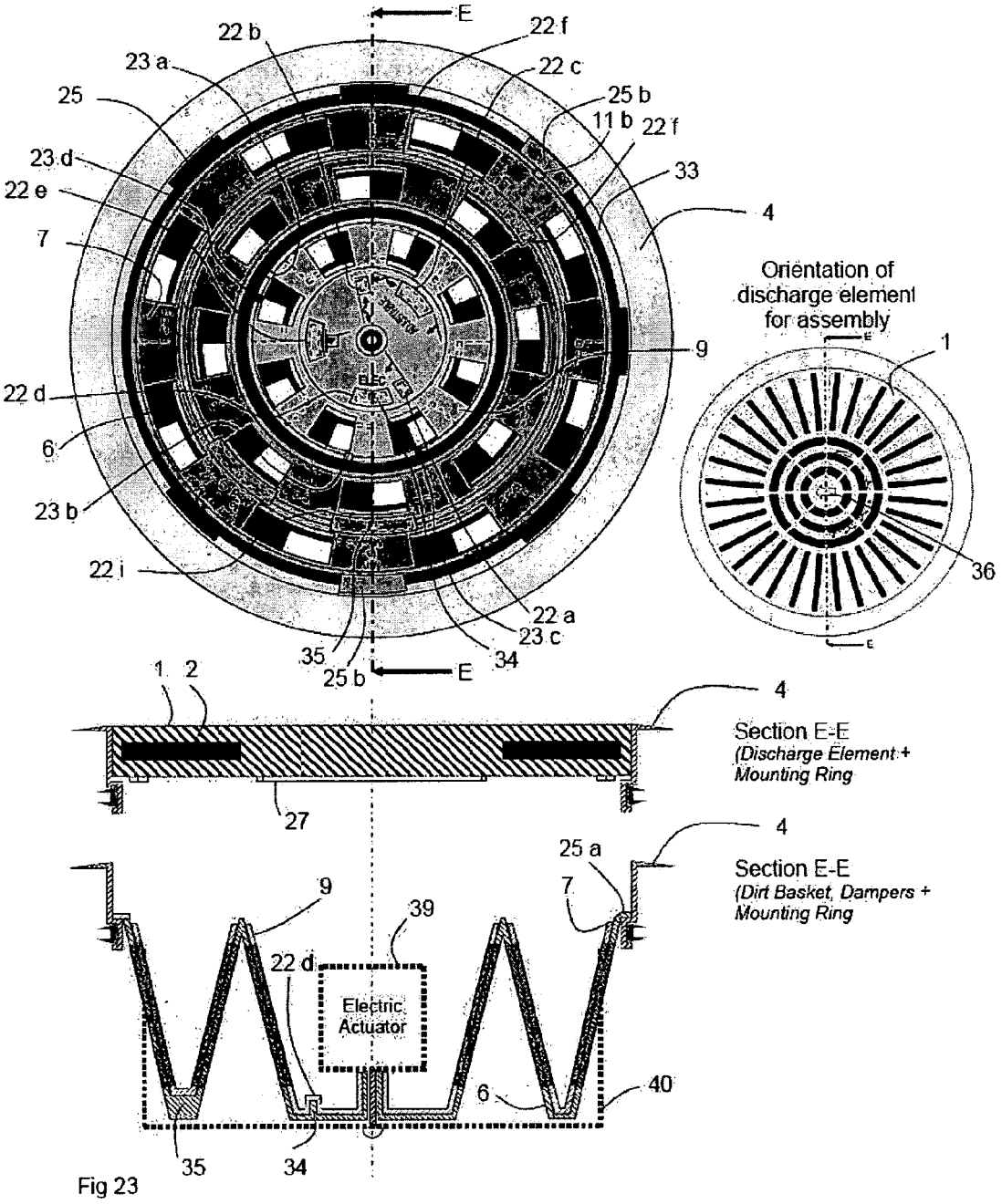
FIG. 23 is a diagram illustrating the mounting ring, dirt collecting basket, swirl damper and directional damper orientation, as well as the electric actuator mechanism, of the embodiment shown in FIG. 16 configured for electric actuator airflow rate adjustment with manual directional-radial pattern adjustment.

FIG. 23 shows the top view of the mounting ring with dirt collecting basket and dampers, as well as the associated side view, plus a side view of discharge element (1) with swirl slots (3) that produce an air pattern with radial swirl bias, and component orientation for diffuser assembly to realise an "electric actuator airflow rate adjustment" configuration. An electric actuator accessory, comprising an electrical actuator (39) located inside the central chamber of dirt collecting basket (6), as shown, or beneath the dirt collecting basket (not shown for the sake of simplicity) with actuator arms (40) attached to swirl damper (7), is mounted to dirt collecting basket (6). The actuator assembly may be fitted in the factory or retrofitted on site. The discharge element feet (26 & 27) rest on recessed edge (33) of mounting ring (4) raising the underside of discharge element (1) clear of the five dirt collecting basket lips (25*a*) and two dummy lips (25*b*), which also rest on recessed edge (33) of mounting ring (4). The two removable dummy lips (25*b*), shown at the 9 o'clock and half past one positions in the plan view, clip onto dirt collecting basket (6) into any two of three possible locations (9 o'clock, 6 o'clock and half past one), with that location left blank that coincides with markings (not shown for the sake of simplicity) on the dirt collecting basket indicating the configuration that is being assembled. The 9 o'clock location will be marked "electrical", the 6 o'clock location "directional or radial" and the half past one location "directional-radial adjustment" (in the case of FIG. 23 this configuration is "electrical actuator airflow rate adjustment", which corresponds with the 9 o'clock location). Directional damper (9) is installed with "electrical adjustment" slot (22*d*) over nipple (34). Indicators (23*c* & 23*d*) lock directional damper (9) into place so that its configuration setting cannot be inadvertently disturbed (e.g. by cleaners opening the diffuser). Swirl damper (7) is installed orientated such that ridge (35) protrudes into slot min-max (22*i*). The two dummy lips (25*b*) lock swirl damper (7) into place so that its configuration setting cannot be inadvertently disturbed (e.g. by cleaners opening the diffuser). Discharge element (1), orientated as shown with the directional arrow (36) directed towards the location with a missing dummy lip (9 o'clock in this instance), this being the only orientation in which elongated foot (27) will enable assembly for this configuration, is placed into mounting ring (4). Nipple (11*b*) slots into concentric recess (30), and indicators (23*a*, 23*b* & 23*d*) notch into dimple (31) and recess (32) to be hidden from view and to lock directional damper (9) to rotate with discharge element (1), whilst indicator (23*c*) protrudes into concentric slot (3) to be visible from within the room, as shown in FIG. 24.

FIG. 24 summarises discharge pattern, direction and airflow rates available in the "electric actuator airflow rate adjustment" configuration shown in FIG. 23 and shows associated indicator (23*c*) location in each instance.

FIG. 25 shows the top view of the mounting ring with dirt collecting basket and dampers, as well as the associated side view, plus a side view of discharge element (1), and component orientation for diffuser assembly to realise an "under-seat directional swirl" configuration for auditoria. Damper basket accessory (37) with a partially perforated base (38) to act as a fixed damper for the reduced airflow and noise requirements of the under-seat configuration is affixed to the underside of dirt collecting basket (6) blanking off the outer ring of openings in dirt collecting basket (6). Not shown, for the sake of simplicity, is an embodiment in which dirt collecting basket (6) is replaced with a similarly shaped alternate collecting basket that only has the two inner rings of air inlet openings; this alternate dirt collecting basket may have perforated air inlet openings or may have a separate perforated plate affixed to its underside. The discharge element feet (26 & 27) rest on recessed edge (33) of mounting ring (4) raising the underside of discharge element (1) clear of the five dirt collecting basket lips (25*a*) and two dummy lips (25*b*), which also rest on recessed edge (33) of mounting ring (4). The two removable dummy lips (25*b*), shown at the nine o'clock and half past one positions in the plan view, clip onto dirt collecting basket (6) into any two of three possible locations (9 o'clock, 6 o'clock and half past one), with that location left blank that coincides with markings (not shown for the sake of simplicity) on the dirt collecting basket indicating the configuration that is being assembled. The 9 o'clock location will be marked "electrical", the 6 o'clock location "directional or radial" and the half past one location "directional-radial adjustment" (in the case of FIG. 25 this configuration is "directional swirl", which corresponds with the 6 o'clock location). Directional damper (9) is installed with "seat" slot (22*e*) over nipple (34) (shown in FIG. 19). Indicators (23*c* & 23*d*) lock directional damper (9) in place so that its configuration setting cannot be inadvertently disturbed (e.g. by cleaners opening the diffuser). Swirl damper (7) is installed in one of five orientations such that ridge (35) (shown in FIG. 19) slots into fixed airflow stop positions min, low, med (as shown), high, or max (22*f*). The two dummy lips (25*b*) lock swirl damper (7) into place so that its configuration setting cannot be inadvertently disturbed (e.g. by cleaners opening the diffuser). Discharge element (1), orientated as shown with the directional arrow (36) directed towards the location with a missing dummy lip (6 o'clock in this instance), this being the only orientation in which elongated foot (27) will enable assembly for this configuration, is placed into mounting ring (4). Nipple 11*b* notches into dimple 29, indicators (23*a* &

23*b*) slot into dimple (31) and recess (32) to be hidden from view and to lock directional damper (9) to rotate with discharge element (1), indicator (23*c*) is also hidden from view by slotting into the second recess (32), and indicator (23*d*) protrudes into concentric slot (3) to be visible from within the room, as shown in FIG. 26. After installation of the diffuser in the floor penetration, discharge element (1) is rotated until directional arrow (36) points towards the rear of the seat.

FIG. 26 summarises discharge direction and airflow rates available in the "under-seat directional swirl" configuration shown in FIG. 25 and shows associated indicator (23*a*) location in each instance.

FIG. 27 shows task-ambient conditioning of an office space in which two diffusers as described by embodiments of the invention are depicted, each with a discharge element with swirl slots that produce swirl discharge with a vertical bias, and with manually adjustable airflow rate: a) configured to a directional swirl pattern with inclined axis that additionally provides manual discharge direction adjustment by rotation; b) configured to a vertical swirl pattern:

i) a) shows the directional swirl pattern with inclined axis manually adjusted to a high airflow rate and rotated towards the seated occupant.
   b) shows the vertical swirl pattern manually adjusted to a high airflow rate.
ii) a) shows the directional swirl pattern with inclined axis manually adjusted to a low airflow rate and rotated towards the seated occupant.
   b) shows the vertical swirl pattern manually adjusted to a high airflow rate.
iii) a) shows the directional swirl pattern with inclined axis manually adjusted to a low airflow rate and rotated away from the seated occupant.
   b) shows the vertical swirl pattern manually adjusted to a low airflow rate.

FIG. 28 shows task-ambient conditioning of an office space in which two diffusers as described by embodiments of the invention are depicted, each with a discharge element with swirl slots that produce swirl discharge with a vertical bias: a) with preset or electrically adjustable airflow rate providing a directional swirl pattern with inclined axis that may be manually rotated to change discharge direction and that may additionally be manually adjusted to a vertical swirl pattern; b) configured for a vertical swirl pattern with manually adjustable airflow rate:

i) a) shows the directional swirl pattern with inclined axis and with preset or electrically adjusted airflow rate (depicted high) directed towards the seated occupant.
   b) shows the vertical swirl pattern adjusted to a high airflow rate.
ii) a) shows the directional swirl pattern with inclined axis and with preset or electrically adjusted airflow rate (depicted high) directed away from the seated occupant.
   b) shows the vertical swirl pattern adjusted to a low airflow rate.
iii) a) shows the diffuser with preset or electrically adjusted airflow rate (depicted high) adjusted to a vertical swirl pattern.
   b) shows the vertical swirl pattern adjusted to a low airflow rate.

FIG. 29 shows airflow rate, pattern and direction schematics relating to FIG. 5, incorporating a discharge element (1) with a vertical bias to the swirl discharge pattern. Swirl damper (7), manually adjustable by removing discharge element (1), is shown set fully open creating swirl discharge (18) in both diagrams a) and b). Directional damper (9), adjustable by rotating discharge element (1), is shown fully open in diagram a) and closed in diagram b). Swirl discharge (18) in diagram b) rises from the diffuser perpendicular to the floor as vertically directed axial swirl discharge (20*i*) into the occupancy space (16). Counter-clockwise rotation of discharge element (1) in diagram b) rotates directional damper (9) from the closed to the open position, as in diagram a), creating directional discharge with inclined axis (15) that induces the surrounding swirl discharge (18) upwards to form a directional swirl discharge pattern with inclined axis (19) into the occupancy space (16). Further counter-clockwise rotation pushes directional damper (9) against limiting stop (12) rotating the directional swirl discharge direction (19) counter-clockwise about the diffuser central axis without altering airflow rate or pattern. Clockwise rotation of swirl element (1) from a) to b) shuts directional damper (9), preventing directional discharge in diagram b). In the absence of an inclined jet (15), swirl discharge (18) rises perpendicular to the floor creating a vertically directed axial swirl discharge pattern (20*i*).

FIG. 31 summarises airflow rate, pattern and direction options relating to FIG. 7.

Not shown, is the case in which directional damper (9) in FIG. 6 is closed, whereby counter-clockwise rotation of a discharge element (1) equipped with swirl slots (3) that provide a vertical swirl bias opens swirl damper (8) producing a vertically directed axial swirl pattern (20*i*), whereas clockwise rotation shuts off the vertically directed axial swirl airflow. FIG. 30 summarises associated airflow rate, pattern and direction options.

FIG. 32 shows the top and bottom views, as well as a section, of an embodiment of discharge element (1), as well as the top view of mounting ring (4). The discharge face of discharge element (1) comprises radial swirl slots (2) that may be largely helical in section to discharge air in a swirling pattern with vertical bias, and concentric slots (3) that discharge air in a directional jet of inclined axis. Symbols on the face, when read in conjunction with indicators (23*a*) and (23*d*)—not shown in FIG. 32 but described in the following paragraphs and shown in FIG. 33—provide evidence of diffuser configuration, discharge pattern, discharge direction, and airflow rate. The underside of discharge element (1) is equipped with eight protruding feet (26), as well as six outer dimples (29) and two outer concentric depressions (30), as well as one inner dimple (31) and one inner concentric depression (32). Not shown, for the sake of simplicity, is an embodiment with a spring lock, or similar, that locks discharge element (1) into mounting ring (4) to prevent unauthorised removal of discharge element (1) by users.

FIG. 33 shows, for the embodiment shown in FIG. 32, the top view of the mounting ring with dirt collecting basket and dampers, as well as the associated side view, plus a side view of discharge element (1), and component orientation for diffuser assembly to realise a "directional swirl" configuration. The discharge element feet (26) rest on recessed edge (33) of mounting ring (4) raising the underside of discharge element (1) clear of the eight dirt collecting basket lips (25*a*), which also rest on recessed edge (33) of mounting ring (4). Directional damper (9) is installed with "directional" dimple (22*a*) pressed onto nipple (34). Dirt collecting basket (6) is installed into mounting ring (4) with the directional discharge symbol on dirt collecting basket (6) in approximately the 6 o'clock position (i.e. nearest the installer). Swirl damper (7) is installed in one of eight orientations with directional discharge symbols such that one of these directional discharge symbols corresponds with that on the dirt collecting basket, and such that ridge (35) slots into fixed airflow stop positions min, low, med (as shown), high, or max (22*f*), or into airflow range stops min-med (22*h*), med-max (22*g*), or into airflow range stop min-max (22*i*). Discharge element (1), orientated as shown with the directional arrow (36) directed towards the installer (6 o'clock), is placed into mounting ring (4). Nipples (11*b*) notch into dimples (29), and indicator (23*a*) slots into concentric recess (32) to be hidden from view whilst indicator (23*c*) protrudes into concentric slot (3) to be visible from within the room, as shown in FIG. 34.

FIG. 34 summarises discharge pattern, direction and airflow rates available in the "directional swirl" configuration depicted in FIG. 34 and shows associated indicator (23*c*) location in each instance.

Similarly to FIG. 33, and hence not shown for simplicity, a "vertical swirl" configuration may be assembled by orientating the vertical discharge symbol (shown in the 3 o'clock position in FIG. 33) of dirt collecting basket (6) to approximately the 6 o'clock position (i.e. towards the installer). Directional damper (9) is installed with "vertical" dimple (22*j*) pressed onto nipple (34). Swirl damper (7) is installed in one of eight orientations with vertical discharge symbols such that one of these vertical discharge symbols corresponds with that on the dirt collecting basket, and such that ridge (35) slots into fixed airflow stop positions min, low, med, high, or max (22*f*), or into airflow range stops min-med (22*h*), med-max (22*g*), or into airflow range stop min-max (22*i*). Discharge element (1), orientated with the directional arrow (36) directed towards the installer (6 o'clock), is placed into mounting ring (4). Nipples (11*b*) notch into dimples (29), and indicator (23*c*) slots into concentric recess (32) to be hidden from view whilst indicator (23*a*) protrudes into concentric slot (3) to be visible from within the room, as shown in FIG. 35.

FIG. 35 summarises discharge pattern, direction and airflow rates available in the "vertical swirl" configuration described in the preceding paragraph and shows associated indicator (23*a*) location in each instance.

In a similar installation manner to that described in the above paragraphs from FIG. 33 onwards, and hence not shown for simplicity, configurations for "Directional-Vertical" and "Electric Actuator Airflow Rate Adjustment" may be assembled, for which FIG. 36 summarises available discharge pattern, direction and airflow rates and shows associated indicator (23*c*) location in each instance.

FIG. 37 Section I-I shows manual locking of ridge (35) in the Min-Max (22*i*) slots of swirl damper (7) into Min, Low, Medium (as drawn), High or Max positions for the "Directional-Vertical" configuration in comparison to the unlocked state required for the "Electrical Actuator" configuration (Section K-K) that provides electrical airflow rate adjustment of swirl damper (7) from Min-Max.

Not shown, is the "under-seat directional swirl" configuration, which is installed in the same way as "directional swirl" described above, with the exception that directional damper (9) is orientated with seat slot (22*e*) over dimple (34). Swirl damper (7) is orientated for ridge (35) to slot into fixed airflow stop positions min, low, med, high, or max (22*f*). Indicator (23*c*) protrudes into concentric slot (3) of discharge element (1) to be visible from within the room. A special swirl damper (7) and a special directional damper (9) each with perforated airflow openings rather than ones that are completely open, so as to reduce the airflow rate, may be used, or alternatively a special dirt basket (6) with perforated openings may be used for this purpose, or a fixed damper (38 in FIG. 25) may be installed to achieve the reduced airflow rates at low noise required for air discharge beneath auditorium seating.

Advantageous Features of the Embodiments Described Herein

An air delivery system incorporating the diffuser described herein provides the potential for substantial energy savings and enhanced indoor air quality, as well as for improved thermal comfort:

- Underfloor air delivery systems operating in cooling mode typically supply conditioned air at about 18° C. to the space. Appropriate diffuser design and selection prevents the supply air stream from mixing to a high level so as to create a low level occupancy microclimate above which heat, rising by natural convection from heat sources in the space, accumulates in a buoyant stratified layer beneath the ceiling. The temperature of the stratified layer is usually 28° C. to 30° C., based on a typical office with a 2.7 m to 3.0 m high ceiling. However, the temperature of the lower lying cooler occupancy microclimate is usually maintained between 22° C. and 24° C. This is similar to the space temperature maintained by a high level air delivery system, which typically supplies conditioned air at about 12° C. to the space through ceiling mounted diffusers that strongly mix the supply air with room air: air is removed from the space at a room air temperature of approximately 22° C. to 24° C. In each case, the temperature differential between air removed from the space and that supplied to the space is approximately 10 K to 12 K. Consequently, for a given airflow rate (equating to approximately the same fan energy) the amount of heat removed from the space is similar for both systems even though the supply air temperature of the underfloor air delivery system is approximately 6 K warmer than that of the high level air delivery system. As a result, the underfloor air delivery system provides substantial potential for energy savings through the extended use of economy cycle "free cooling" (by extending the number of days when "free" outdoor air may be used to cool the space) and allows a higher chilled water temperature to be used on days when mechanical cooling is required, thereby also improving chiller efficiency (COP).
- Contaminants emitted by heat sources in the space, such as $CO_2$ from users and VOC's from computers and lights, rise by convection in the plumes of heat emanating from heat sources to accumulate in concentrated form in the layer of stratified heat above the occupancy microclimate, where they are removed from the space with minimal mixing into the occupancy microclimate.
- Supply air is delivered directly into the low level occupancy microclimate. The fresh air component of the supply air is therefore supplied more directly to users with minimal dilution by contaminants in the space.
- Diffusers near each workstation are readily accessible to the individual users allowing for individual adjustment of each occupant's local thermal environment—called "task" conditioning—to enhance personal comfort.
- The provision of adjustable "task" conditioning makes it possible to relax temperature control in transient spaces or where prolonged occupancy does not occur, to further save energy in these general and wide-spread "ambient" spaces that have a lower thermal priority.

In order for "task-ambient" conditioning to be effective, diffuser control must be provided in the direct vicinity of each occupant's work station, and such control must be possible from within the room without requiring either tools or the removal of any diffuser components. In order to be readily usable, the diffuser must also provide the user with intuitive feedback of adjustability options and status. The embodiments described herein provide the aforementioned features.

The floor swirl diffuser in accordance with the embodiments described herein provides manual diffuser adjustability to users within the room (i.e. without the need for tools or to dismantle any part of the diffuser) of airflow rate, pattern, and direction, thereby expanding the degree of occupant thermal control adjustability beyond that achievable with the prior art.

For each of the two discharge element types (i.e. either with swirl slots that produce a radial swirl bias or with ones that produce a vertical swirl bias) three standard configurations can be assembled, or retrospectively re-assembled on site, by simply opening the diffuser from above and resetting its components without removing the diffuser from the floor penetration and without the need for additional components: for a discharge element with swirl slots that produce a radial swirl bias, the three standard configurations comprise a directional swirl pattern with inclined axis and with adjustable airflow rate to a largely constant height and adjustable airflow direction, a horizontally directed displacement type radial swirl pattern with adjustable airflow rate, and combined airflow rate and pattern adjustment from the lower airflow rate horizontally directed displacement type radial swirl pattern to the higher airflow rate directional swirl pattern with direction adjustment; for a discharge element with swirl slots that produce a vertical swirl bias, the three standard configurations comprise a directional swirl pattern with inclined axis and with adjustable airflow rate to a largely constant height and adjustable airflow direction, a vertically directed swirl pattern with adjustable airflow rate, and combined airflow rate and pattern adjustment from the lower airflow rate vertical swirl pattern to the higher airflow rate directional swirl pattern with direction adjustment. As a result, for each discharge element, a single product replaces a multitude of different products of the prior art that each served a different function, as the product described by the invention can readily be configured or reconfigured to any one of three functions.

Regardless of which of the two discharge elements (radial swirl or vertical swirl) has been used, the floor swirl diffuser offers two additional special configurations requiring accessories that can be retrofitted on site:

Special Configuration: Electrical Airflow Rate Adjustment. This configuration requires an accessory to electrically operate the diffuser swirl damper. In this configuration the floor swirl diffuser adjusts airflow rate electrically.

This is combined with manual discharge pattern adjustment from radial swirl to directional swirl with direction adjustment for the discharge element with swirl slots that discharge a swirl pattern with radial bias, and from vertical swirl to directional swirl for the discharge element with swirl slots that discharge a swirl pattern with vertical bias. Moreover, in each case, the airflow rate of the former pattern is lower than that of the latter. Consequently, an occupant may, by manual adjustment, increase, concentrate and direct the airflow from an electrically controlled diffuser to enhance the perceived cooling effect, or vice versa. Unlike diffusers of the prior art, the floor swirl diffuser of the present invention provides substantial individual occupant thermal comfort control even when diffusers are electrically controlled.

Special Configuration: Under-Seat Directional Swirl. This configuration requires a fixed damper accessory that modifies the diffuser pressure characteristics to throttle airflow quietly to a range and throw suitable for air discharge from beneath auditorium seating, or special perforated dampers or a special perforated basket are required. The discharge pattern is directional swirl with direction adjustment. Five airflow rate options can be set by opening the diffuser without removing it from the floor penetration. By directing the airflow pattern of the diffuser installed beneath a seat towards the seat rear, draught risk in the sensitive leg region of the seated occupant is reduced. Unlike floor swirl diffusers of the prior art, the floor swirl diffuser of the current embodiments described herein reduces draught risk in under-seat auditorium applications and also offers a variety of airflow rate options.

In the standard configuration that discharges only a directional swirl pattern, the floor swirl diffuser in accordance with the embodiments described herein provides manual adjustability of both airflow rate and airflow direction, thereby providing a substantially greater degree of individual thermal comfort control. For reduced cooling, in addition to manual airflow rate reduction, the facility for users to direct the air stream away from them enables the perceived cooling effect to be further reduced—beyond that offered by airflow rate adjustment alone. Where maximum airflow has been selected to deal with a large thermal load, the facility for users to direct the air stream away from them (especially if a diffuser is located directly next to a user) allows such cooling to be achieved without creating draughts. Where the maximum airflow rate is insufficient to cover the thermal load, the ability to direct the air stream towards a user provides a greater localised task cooling effect due to increased air motion, extending the band of thermal comfort achieved without the need for more airflow than the diffuser is able to supply. In contrast to the prior art, the embodiments described herein provide extended thermal comfort control by offering, in a single configuration, user adjustability from within the room of both airflow rate and direction. Moreover, in this standard configuration, the floor swirl diffuser in accordance with the embodiments described herein maintains throw to a generally constant height regardless of the airflow rate adjustment by the user. Unlike the prior art's floor swirl diffusers with adjustable airflow rate, over-throw and under-throw of the air stream height are averted as diffuser airflow rate is adjusted, thereby preventing disturbance of the high level stratified layer at high airflow rates or the sensation of cold feet/warm head at low airflow rates.

The floor swirl diffuser described herein includes a standard configuration in which the discharge pattern is altered from horizontally directed displacement type radial swirl to directional swirl with an inclined axis for the discharge element with swirl slots that discharge a swirl pattern with radial bias, or from vertical swirl to directional swirl with an inclined axis for the discharge element with swirl slots that discharge a swirl pattern with vertical bias, as the diffuser airflow rate is increased manually by the user, and that then allows the upward directional swirl pattern to be directed towards or away from the user by rotation through 360 degrees. This provides adjustability from low density and broadly spread "ambient" cooling to higher density concentrated "task" cooling.

The floor swirl diffuser described herein further includes indicators visible from within the room that show which of the three standard configurations has been assembled, as well as providing evidence of the airflow rate, airflow pattern and airflow direction adjustment options and status, allowing engineers to readily check for correct configuration and adjustment and providing ergonomic diffuser feedback and control to users.

By providing individual adjustability of airflow rate, airflow pattern, and airflow direction from the same diffuser, and by additionally allowing these to be configured in different ways, the embodiments described herein offer a more appropriate and substantially greater degree of user adjustability than is possible with floor swirl diffusers of the prior art. The greater combined adjustability offered by the embodiments described herein allows both local thermal environments to be more greatly personalised and greater variances between effective "task" and "ambient" temperatures in the occupancy zone to be achieved, thereby enhancing thermal comfort whilst simultaneously realising energy savings beyond those possible with floor swirl diffusers of the prior art.

Further ongoing client savings are also achieved as the diffuser can be reconfigured on site to suit tenancy changes or a client's changing needs. Replacing a multitude of diffuser types of the prior art with the single multi-configurable diffuser of the invention also realises savings due to reduced product tooling requirements and minimal stock variants, thereby reducing initial capital costs.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

Any reference to prior art contained herein is not to be taken as an admission that the information is common general knowledge, unless otherwise indicated.

The claims defining the invention are as follows:

1. An air diffuser comprising:

a hand-manipulable discharge element that is rotatable through 360° about an axis perpendicular to a surface of the discharge element, the discharge element comprising swirl openings arranged to discharge a swirl pattern of air and at least one directional opening arranged to discharge a jet pattern of air, wherein in use, the discharged jet pattern of air is able to induce the discharged swirl pattern of air to form a combined air stream; and a collecting basket having air inlets, the collecting basket having at least one chamber fitted with and thereby supporting at least one of a jet damper and swirl damper;

wherein the at least one of the jet damper and swirl damper comprises openings arranged in substantially conical or cylindrical surfaces about the axis perpendicular to the surface of the discharge element such that, when the at least one of the jet damper and swirl damper is rotated through an arc of rotation about the axis perpendicular to the surface of the discharge element, this is able to effect opening and closure of the openings of the at least one of the jet damper and swirl damper and the air inlets of the collecting basket;

wherein the at least one of the jet damper and swirl damper is mechanically linked to the discharge element to enable rotation thereof through the arc of rotation to effect opening and closure of the openings of the at least one of the jet damper and swirl damper, whereby rotation of the discharge element about the perpendicular axis rotates the at least one of the jet damper and swirl damper so as to vary at least two of an airflow rate, an airflow pattern and an airflow direction.

2. The air diffuser in accordance with claim 1, wherein the airflow pattern produced by the discharge element is at least one of a substantially perpendicular axial swirl pattern relative to a discharge element surface, a substantially inclined swirl pattern relative to a perpendicular axis of the discharge element surface and a substantially parallel radial swirl pattern relative to the discharge element surface.

3. The air diffuser in accordance with claim 2, wherein the airflow pattern is alterable between the substantially inclined swirl pattern and either the substantially parallel radial swirl pattern or the substantially perpendicular swirl pattern.

4. The air diffuser in accordance with claim 1, wherein rotation of the discharge element about the axis substantially perpendicular to the surface of the discharge element varies the airflow rate discharged by the diffuser.

5. The air diffuser in accordance with claim 1, wherein the discharge element is able to maintain a substantially constant throw height for the combined airstream relative to the surface of the discharge element upon adjustment of an airflow rate of the swirl pattern of air.

6. The air diffuser in accordance with claim 1, wherein rotation of the discharge element about the axis perpendicular to the surface of the discharge element changes the airflow pattern from a substantially parallel displacement type radial swirl pattern or a substantially perpendicular axial swirl pattern to a substantially unidirectional swirl pattern inclined relative to the perpendicular axis of the discharge element surface.

7. The air diffuser in accordance with claim 6, wherein the airflow pattern is varied as the airflow rate is adjusted by a user.

8. The air diffuser in accordance with claim 1, wherein the discharge element further comprises a central portion arranged to discharge the jet pattern of air that is inclined substantially in one direction to the axis perpendicular to the surface of the discharge element.

9. The air diffuser in accordance with claim 8, wherein the discharge element further comprises a discharge portion arranged to discharge the swirl pattern of air.

10. The air diffuser in accordance with claim 9, wherein the discharge portion substantially surrounds the central portion.

11. The air diffuser in accordance with claim 8, wherein the collecting basket includes a first and a second chamber, the first chamber being substantially circular and substantially located upstream of the central portion of the discharge element.

12. The air diffuser in accordance with claim 11, wherein the second chamber is substantially annular and substantially located upstream of the discharge portion of the discharge element.

13. The air diffuser in accordance with claim 12, wherein the first chamber is fitted with and thereby supports the jet damper and the second chamber is fitted with and thereby supports the swirl damper.

14. The air diffuser in accordance with claim 13, wherein the jet damper and swirl damper are each linked to the discharge element to effect opening and closure of the dampers upon rotation of the discharge element about the axis perpendicular to the surface of the discharge element.

15. The air diffuser in accordance with claim 13, further including damper stops that provide at least one of a plurality of fixed airflow rates and a selection of airflow rate ranges.

16. The air diffuser in accordance with claim 1, wherein the collecting basket is arranged to collect detritus.

17. The air diffuser in accordance with claim 1, further including at least one visual feedback element arranged to indicate at least one of the airflow pattern, rate and direction of the diffuser.

18. The air diffuser in accordance with claim 1, wherein rotation of the discharge element is able to vary at least two of the airflow rate, the airflow pattern and the airflow direction substantially independently of one another.

19. An air supply system incorporating at least one air diffuser in accordance with claim 1.

* * * * *